US009706821B2

(12) United States Patent
Tseng et al.

(10) Patent No.: US 9,706,821 B2
(45) Date of Patent: Jul. 18, 2017

(54) COLLAPSIBLE SUITCASE STRUCTURE

(71) Applicant: TWINKLE LEATHERWARE CO., LTD., Kwai Chung (HK)

(72) Inventors: Tzu-Wei Tseng, Kwai Chung (HK); Hung-Sheng Lin, Kwai Chung (HK); Cheng-Cheng Chen, Kwai Chung (HK); Yi-Ju Hsieh, Kwai Chung (HK); Wai-Ming Wong, Kwai Chung (HK)

(73) Assignee: TWINKLE LEATHERWARE CO., LTD., Kwai Chung (HK)

( * ) Notice: Subject to any disclaimer, the term of this patent is extended or adjusted under 35 U.S.C. 154(b) by 398 days.

(21) Appl. No.: 14/267,713

(22) Filed: May 1, 2014

(65) Prior Publication Data

US 2014/0299430 A1 Oct. 9, 2014

Related U.S. Application Data

(63) Continuation-in-part of application No. 13/855,856, filed on Apr. 3, 2013, now Pat. No. 9,204,696.

(51) Int. Cl.

| | |
|---|---|
| ***A45C 13/03*** | (2006.01) |
| ***A45C 5/02*** | (2006.01) |
| ***A45C 5/14*** | (2006.01) |
| ***A45C 7/00*** | (2006.01) |
| ***A45C 13/10*** | (2006.01) |

(52) U.S. Cl.

CPC ..... *A45C 5/02* (2013.01); *A45C 5/14* (2013.01); *A45C 7/0036* (2013.01); *A45C 13/103* (2013.01)

(58) Field of Classification Search

CPC ..... A45C 7/0036; A45C 13/03; A45C 7/0018; A45C 13/1023

USPC ..... 190/39, 100, 107, 903; 383/120

See application file for complete search history.

(56) References Cited

U.S. PATENT DOCUMENTS

| | | | | |
|---|---|---|---|---|
| 2,538,616 A * | 1/1951 | Cross | A45C 7/0036 190/107 |
| 2,560,437 A * | 7/1951 | Guenther | A45C 13/103 190/119 |
| 2,778,397 A * | 1/1957 | Carrasco | B42D 5/005 190/119 |

(Continued)

FOREIGN PATENT DOCUMENTS

| | | |
|---|---|---|
| EP | 0199993 A1 * | 5/1986 |
| FR | 955692 A * | 1/1950 |

(Continued)

*Primary Examiner* — Sue A Weaver
(74) *Attorney, Agent, or Firm* — Maschoff Brennan

(57) ABSTRACT

A suitcase structure includes a back case component, a front lid component and a ring-shaped gusset component. The opposite sides of the ring-shaped gusset component are connected with the edge of the back case component and the edge of the front lid component respectively, so as to form an accommodation space used for being closed. The ring-shaped gusset component includes a plurality of sidewall portions and a plurality of flexible structures linking the sidewall portions. The flexible deformation capability of the flexible structures is greater than the flexible deformation capability of the sidewall portions. The flexible structures has an inclination, and two of the sidewall portions adjacent to each other can be bent and therefore be stacked opposite to each other by the flexible structures linking the two of the sidewall portions.

14 Claims, 35 Drawing Sheets

(56) References Cited

U.S. PATENT DOCUMENTS

| | | | | | |
|---|---|---|---|---|---|
| 5,105,919 | A * | 4/1992 | Bomes | A45C 3/00 | 150/117 |
| 7,175,010 | B1 * | 2/2007 | Miner | A45C 7/0036 | 190/107 |
| 7,845,508 | B2 * | 12/2010 | Rothschild | A45C 7/0036 | 190/107 |
| 8,079,451 | B2 * | 12/2011 | Rothschild | A45F 4/06 | 190/100 |
| 8,978,850 | B2 * | 3/2015 | Bettua | A45C 7/0068 | 190/103 |
| 2005/0034948 | A1 * | 2/2005 | Tiramani | A45C 7/0036 | 190/107 |
| 2007/0137959 | A1 * | 6/2007 | Zauderer | A45C 3/08 | 190/110 |
| 2009/0120752 | A1 * | 5/2009 | Bettua | A45C 5/14 | 190/18 A |
| 2010/0101908 | A1 * | 4/2010 | Chun | A45C 7/0036 | 190/18 A |
| 2010/0282556 | A1 * | 11/2010 | Tseng | A45C 7/0077 | 190/107 |

FOREIGN PATENT DOCUMENTS

| | | | | |
|---|---|---|---|---|
| FR | 2397169 | A1 * | 2/1979 | A45C 3/00 |
| FR | 2827131 | A1 * | 1/2003 | |
| GB | 1221643 | * | 2/1971 | |

* cited by examiner

COLLAPSIBLE SUITCASE STRUCTURE

This application is a continuation-in-part patent application of U.S. application Ser. No. 13/855,856 filed on 2013 Apr. 3, the entire contents of which are hereby incorporated by reference for which priority is claimed under 35 U.S.C. §120.

TECHNICAL FIELD

The disclosure relates to a suitcase, more particularly to a suitcase easy to be stored.

RELATED ART

Before long distance travels, travelers are used to putting all the things needed during the journey in a suitcase. Due to the limit of suitcase's capacity, travelers, however, usually can only store the relatively important belongings in the suitcase and the relatively not important belongings can only be left. Travelers need to buy necessities which cannot be stored in the suitcase after arriving the destinations. Therefore, to avoid the waste caused by repeat purchases of the same necessities, travelers are often fond of high capacity suitcases, in order to store plenty of personal belongings in those suitcases.

Although the high capacity suitcase is able to accommodate more belongings, it may cause storage problems for travelers after their travels. For those families with limited storage spaces, they are particularly troubled by the storage of big suitcases.

Consequently, in order to store suitcases more conveniently, how to make a suitcase with the feature that the size thereof can be reduced after the travels is a problem to be solved for the designers.

SUMMARY

A suitcase structure comprises a back case component, a front lid component and a ring-shaped gusset component. The opposite sides of the ring-shaped gusset component are connected with the edge of the back case component and the edge of the front lid component respectively, so as to form an accommodation space configured for being closed. The ring-shaped gusset component comprises a plurality of sidewall portions and a plurality of flexible structures linking the sidewall portions. The flexible deformation capability of the flexible structures is greater than the flexible deformation capability of the sidewall portions. The flexible structures has an inclination, and two of the sidewall portions adjacent to each other can be bent and therefore be stacked opposite to each other by the flexible structures linking the two of the sidewall portions.

BRIEF DESCRIPTION OF THE DRAWINGS

The present disclosure will become more fully understood from the detailed description given herein below for illustration only, and thus does not limit the present disclosure, wherein.

DETAILED DESCRIPTION

Figure 1:
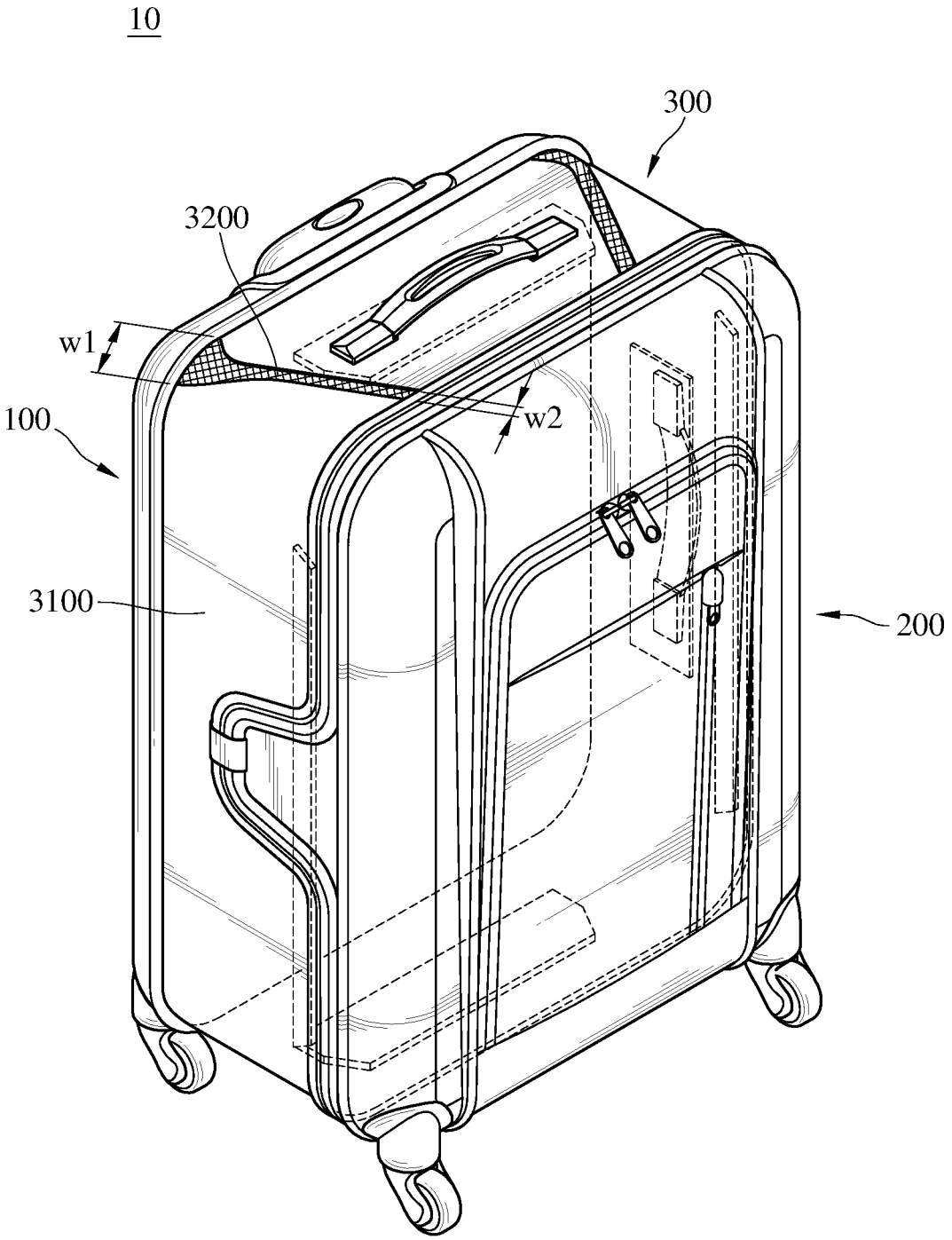
FIG. 1 is a perspective view of a suitcase structure according to the first embodiment of the disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Figure 2:
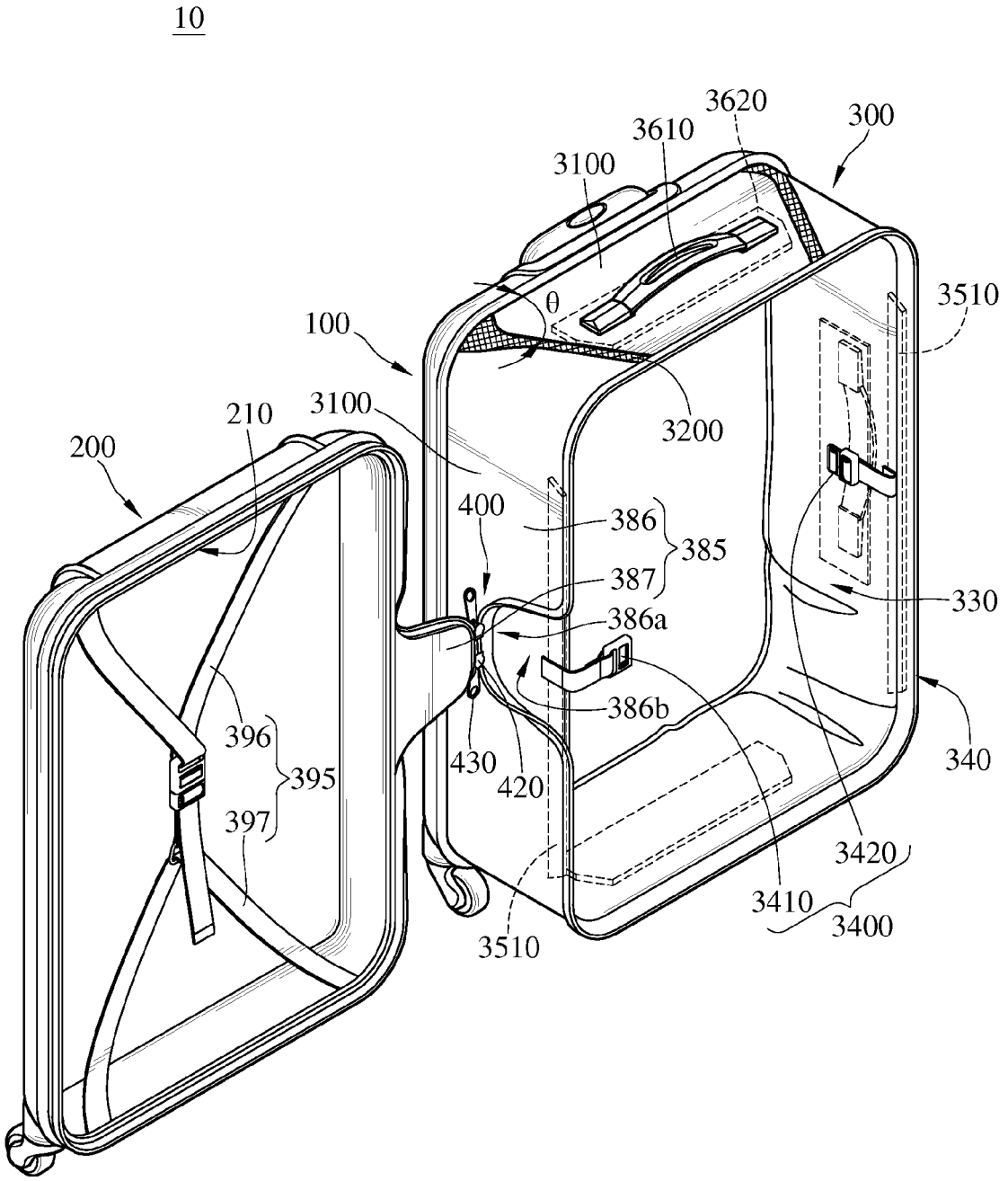
FIG. 2 is a perspective view of the opened suitcase in FIG. 1.
Figure 3:
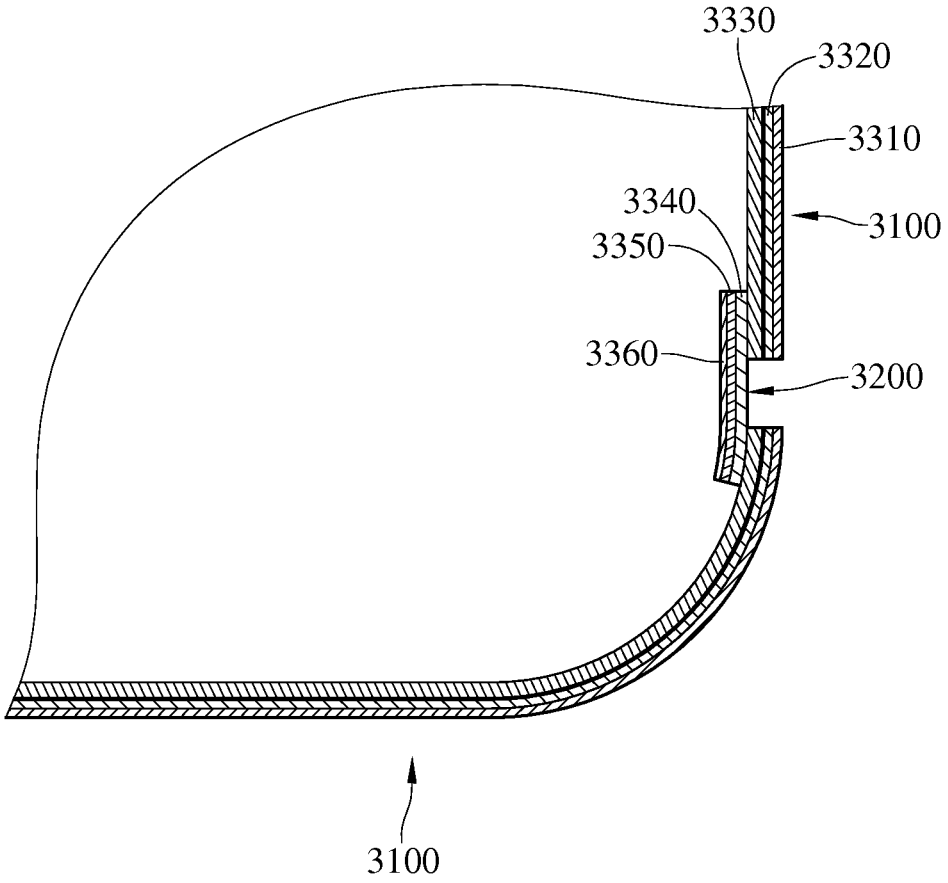
FIG. 3 is a partially sectional view of the ring-shaped gusset component in FIG. 2.
Figure 4:
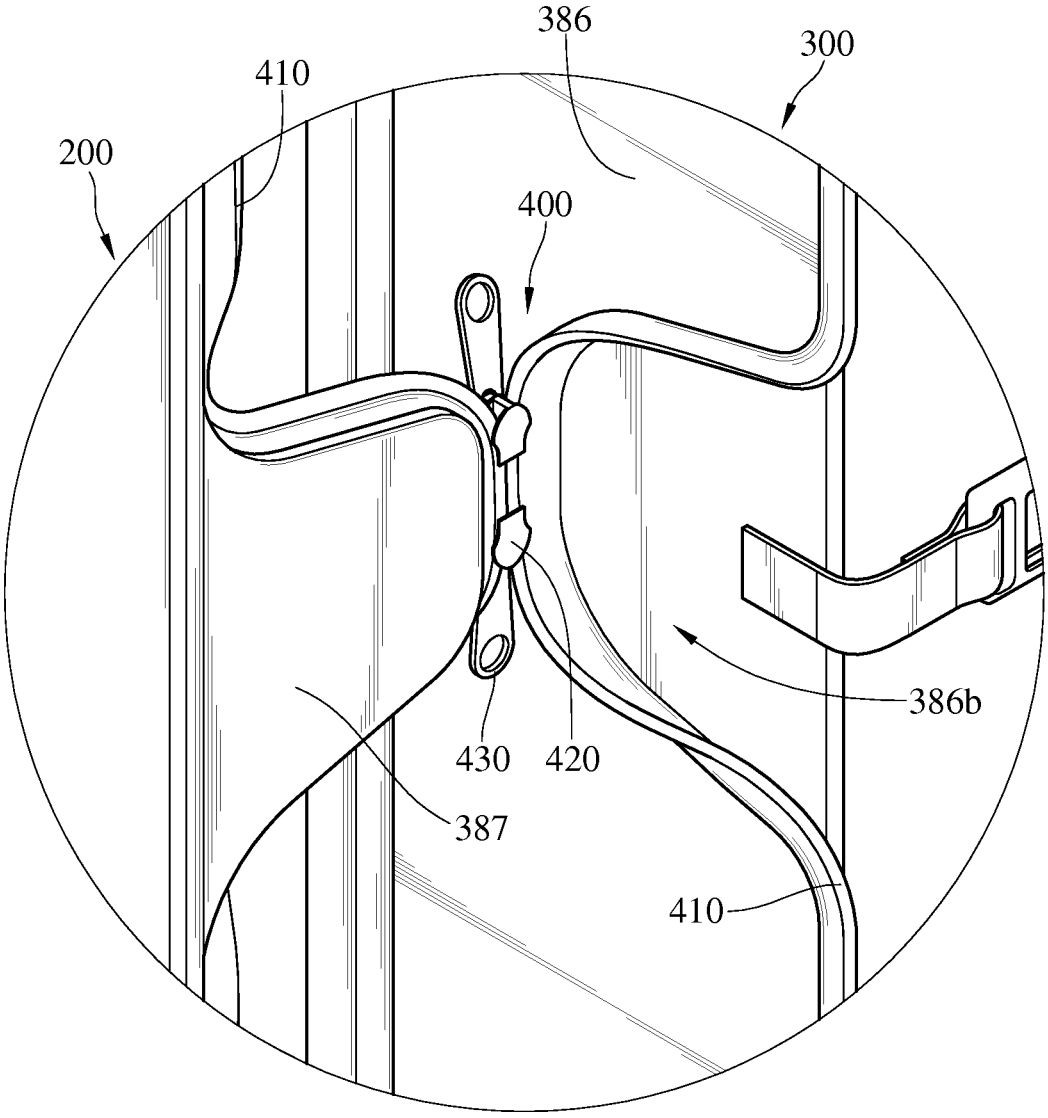
FIG. 4 is an enlarged view of the zipper part in FIG. 2.

FIG. 1 is a perspective view of a suitcase structure; FIG. 2 is a perspective view of the opened suitcase in FIG. 1; FIG. 3 is a partially sectional view of the ring-shaped gusset component in FIG. 2; and FIG. 4 is an enlarged view of the zipper part in FIG. 2.

As seen in FIG. 1 to FIG. 4, the suitcase structure 10 of this disclosure comprises a back case component 100, a front lid component 200 and a ring-shaped gusset component 300. The back case component 100 and the front lid component 200 are made by relatively harder materials for the better protection. For example, they are made by plastic plates such as polyethylene (PE), polypropylene (PP), ethylene-vinyl acetate (EVA), polyvinyl chloride (PVC) or acrylonitrile butadiene styrene (ABS) resin, but the disclosure is not limited thereto. In other embodiments, the back case component 100 and the front lid component 200 may be made by fabrics.

The opposite two sides of the ring-shaped gusset component 300 are connected to the edge of the back case component 100 and the edge of the front lid component 200 respectively, in order to form an accommodating space 330. Additionally, in this embodiment, the ring-shaped gusset component 300 is made by composite materials. For example, it can be made by relatively harder materials such as 1682D cloth, PE, PVC, PP, EVA or ABS and relatively softer materials such as cane cloth, styrene-butadiene rubber (SBR), 150D jersey, polyurethane (PU), rubber, thermoplastic polyurethane (TPU), Sandwich Mesh Fabric, neoprene, polyester, thermoplastic rubbers (TPR), webbing, or leather. Moreover, the ring-shaped gusset component 300 has a plurality of sidewall portions 3100 and a plurality of flexible structures 3200 connect those sidewall portions 3100, while the sidewall portions 3100 and the flexible structures 3200 form the accommodation space 330.

Each flexible structure 3200 extends from the edge of the ring-shaped gusset component 300 connected to the back case component 100 towards the edge of the ring-shaped gusset component 300 connected to the front lid component 200. An inclination θ is formed and maintained between each flexible structure 3200 and the edge of the ring-shaped gusset component 300 connected to the back case component 100. In detail, each flexible structure 3200 of this embodiment extends from each end of the ring-shaped gusset component 300 towards the upper and lower sides of the sidewall portions 3100, so that each flexible structure 3200 has the inclination θ, but this is not intended to limit the disclosure. In other embodiments, each flexible structure 3200 can extend from each end of the ring-shaped gusset component 300 towards the left and right sides of the sidewall portions 3100.

In this embodiment, as shown in FIG. 1, a width w1 of the flexible structure 3200 at an end near the back case component 100 is greater than another wide w2 of the same flexible structure 3200 at an opposite end away from the back case component 100, that is, the width of each flexible structure 3200 gradually decreases along the direction from a place near the back case component 100 to a place away from the back case component 100, but the disclosure is not limited thereto. In other embodiments, the width of the flexible structure 3200 is constant or increases along the direction from a place near the back case component 100 to a place away from the back case component 100. Further, the flexible deformation capability of the flexible structure 3200 is better than that of each sidewall portion 3100. In addition, these flexible structures 3200 are bendable. Thereby, by the flexible deformation capability of the flexible structure 3200, two adjacent sidewall portions 3100 can be bent while being linked so that they can be stacked and erected, thereby having a storage position and a use position.

In this embodiment, each sidewall portion 3100 is made by stacked 1682D cloth layer with PU base, EVA layer 3320 and PP plate layer 3330, but it is not limited thereto. Each flexible structure 3200 is made by stacked cane cloth layer 3340, SBR layer 3350 and 150D jersey layer, but it is not limited thereto. The flexible deformation capabilities of the cane cloth layer 3340, SBR layer 3350 and 150D jersey layer 3360 are greater than the flexible deformation capabilities of 1682D cloth layer 3310 with PU base, EVA layer 3320 and PP plate layer 3330, and the cane cloth layer 3340, SBR layer 3350 and 150D jersey layer 3360 are bendable. Thereby, when the flexible structures 3200 are bent, it drives two sidewall portions adjacent to each flexible structure 3200 to be bent so that those sidewall portions are stacked on the back case component 100 respectively. The aforementioned cane cloth layer 3340 is made by, for example, styrene-butadiene rubber (SBR). In this embodiment, the thickness of the SBR layer is 3 millimeters, the thickness of the EVA layer is 1.5 millimeters, and the thickness of the PP plate layer is 0.8 millimeter, but the disclosure is not limited thereto.

Additionally, the ring-shaped gusset component 300 of this embodiment has a first opening 230, while the front lid component 200 has a second opening 210. One of the aforementioned sidewall portions 3100 has a lateral part 386 and a linking part 387. The lateral part 386 has an outer wall **386*a* and a concave 386*b* located on the outer wall 386*a* of the lateral part 386. A lateral edge of the linking part 387 is connected to the edge of the lateral part 386 which forms the concave 386*b*, while the opposite lateral edge of the linking part 387 is connected to the edge of the second opening 210 of the front lid component 200. That is, the linking part 387 connects the front lid component 200 with the lateral part 386 and is between them. In other embodiments, the lateral part 386 may have a hollow part corresponding to the concave 386*b***.

Furthermore, a zipper 400 is installed on the ring-shaped gusset component 300 to from an accommodation space 330. The zipper 400 comprises two chains 410, two zipper heads 420 and two zipper pieces 430. One of the chains 410 is disposed around the edge of the first opening 340 and the edge of the concave **386*b*, while the other of the chains 410 is disposed around the edge of the second opening 210 and the edge of the linking part 387. The two zipper heads 420 can join the two chains 410 together or separate them from each other for closing or opening the suitcase structure 10, thereby making the linking part 387 cover the lateral part 386 or be away from the lateral part 386. The two zipper pieces 430 are movably disposed on the zipper heads 420 and are out of the accommodation space 330. In this embodiment, the number of the zipper heads 420 is two, but this is not intended to limit the disclosure. In other embodiment, the number of the zipper heads 420 can be just one. The zipper 400 of this embodiment is one of the means of connecting the front lid component with the ring-shaped gusset component 300**, while in other embodiments, Velcro and buttons may be used for connecting them.

In this and some other embodiments, the ring-shaped gusset component 300 further comprises a fixing strap 3400. The fixing strap 3400 comprises a first strap body 3410 and a second strap body 3420. The first strap body 3410 and the second strap body 3420 are disposed on any opposite two sidewall portions 3100. The first strap body 3410 is detachably connected to the second strap body 3420. In this embodiment, the first strap body 3410 and the second strap body 3420 are disposed on the sidewall portions 3100 on the left side and the right side respectively, but the disclosure is not limited thereto. In other embodiments, the first strap body 3410 and the second strap body 3420 are disposed on the sidewall portions 3100 on the top side and the bottom side respectively. The terms "left", "right", "top" and "bottom" are based on the position of the wheels. More precisely, for example, the bottom side is the side closest to the wheel.

In this and some other embodiments, the front lid component 200 further comprises a belt 395. The belt 395 comprises a first belt body 396 and a second belt body 397. The first belt body 396 and the second belt body 397 are disposed on the front lid component 200. The first belt body 396 is detachably connected to the second belt body 397. In this embodiment, the first belt body 396 and the second belt body 397 are disposed on the top side and the bottom side of the front lid component 200 respectively, but the disclosure is not limited thereto. In other embodiments, the first belt body 396 and the second belt body 397 are disposed on the left side and right side of the front lid component 200.

In this and some other embodiments, the suit case structure 10 further comprises two third reinforcing elements 3510 disposed on the left side and the right side of the sidewall portions 3100 respectively. In this embodiment, the number of the third reinforcing elements 3510 is two but it is not limited thereto. In other embodiments, the number of the third reinforcing elements 3510 can be three and they are disposed on three sides of the sidewall portions 3100.

In this and some other embodiments, the suit case structure 10 further comprises a grip 3610 and a fourth reinforcing element 3620 which are disposed on the same sidewall portion 3100. The grip 3610 is located on the outer wall surface of the sidewall portion 3100. The projected area of the fourth reinforcing element 3620 on the sidewall portion 3100 and that of the grip 3610 on the sidewall portion 3100 overlap. The fourth reinforcing element 3620 can be used to improve the structural strength.

In this embodiment, the third reinforcing element 3510 and the fourth reinforcing element 3620 are honeycomb structures, and the thickness of the honeycomb structure of is, but not limited to, 6 millimeters.

Moreover, in this and some other embodiments, the forgoing honeycomb structure can be disposed on the bottom side of the sidewall portions 3100 for improving the loading capability.

The storage process of the suit case structure 10 is illustrated in FIG. 2 and FIG. 5 to FIG. 8, in which FIG. 5 to FIG. 8 are schematic views of the storage process of FIG. 2.

Figure 5:
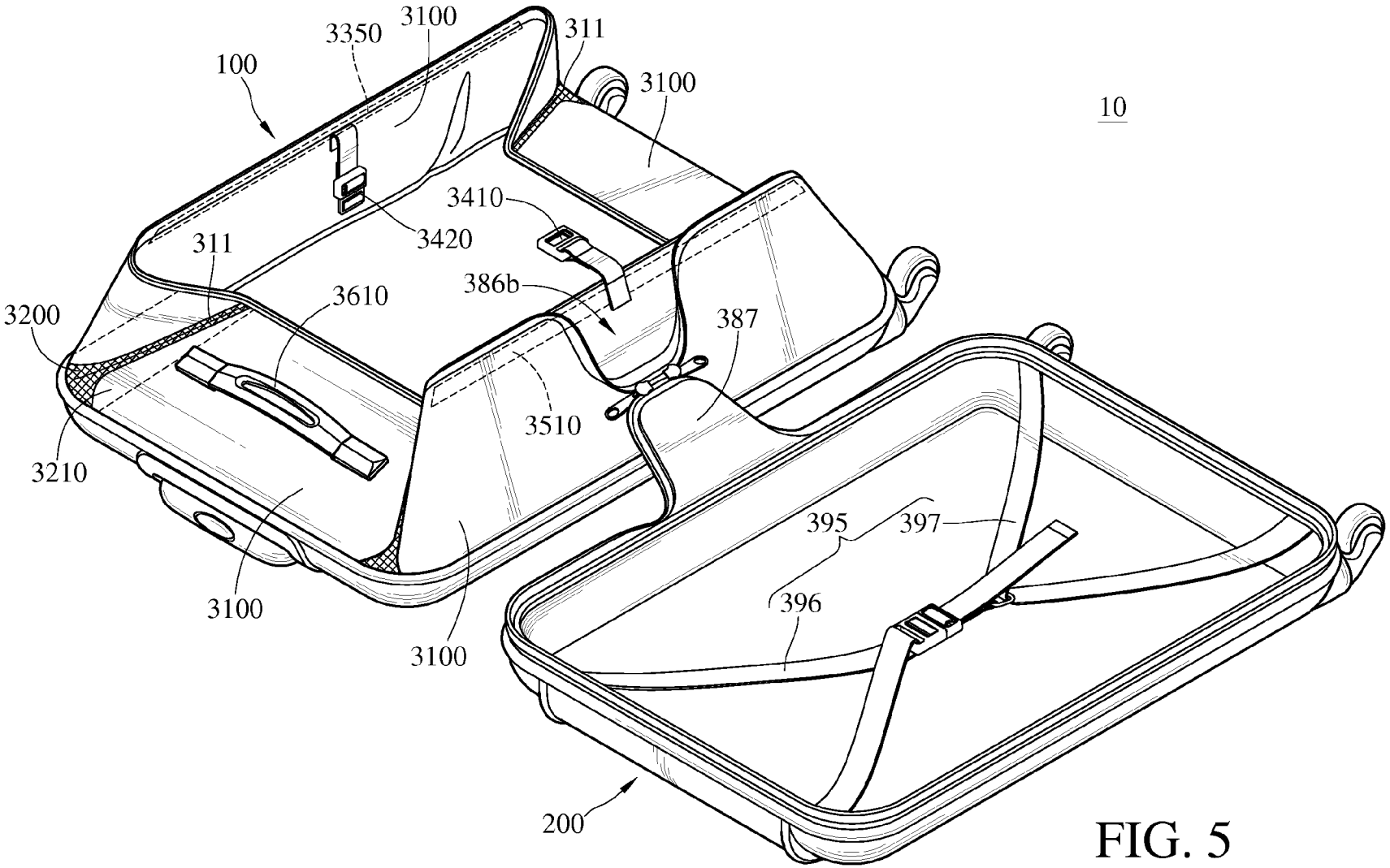
FIG. 5 to FIG. 8 are schematic views of the storage process of FIG. 2.

Firstly as seen in FIG. 2, the ring-shaped gusset component 300 is erected on the back case component 100 and thus is at the use position. In this position, goods can be placed in the accommodation space 330. Then, the ring-shaped gusset component 300 starts being folded. As shown in FIG. 5, based on flexible deformation capability of the flexible structure 3200, the sidewall portions 3100 on the top and bottom sides are first pressed inwardly to form each fold line 311.

Figure 6:
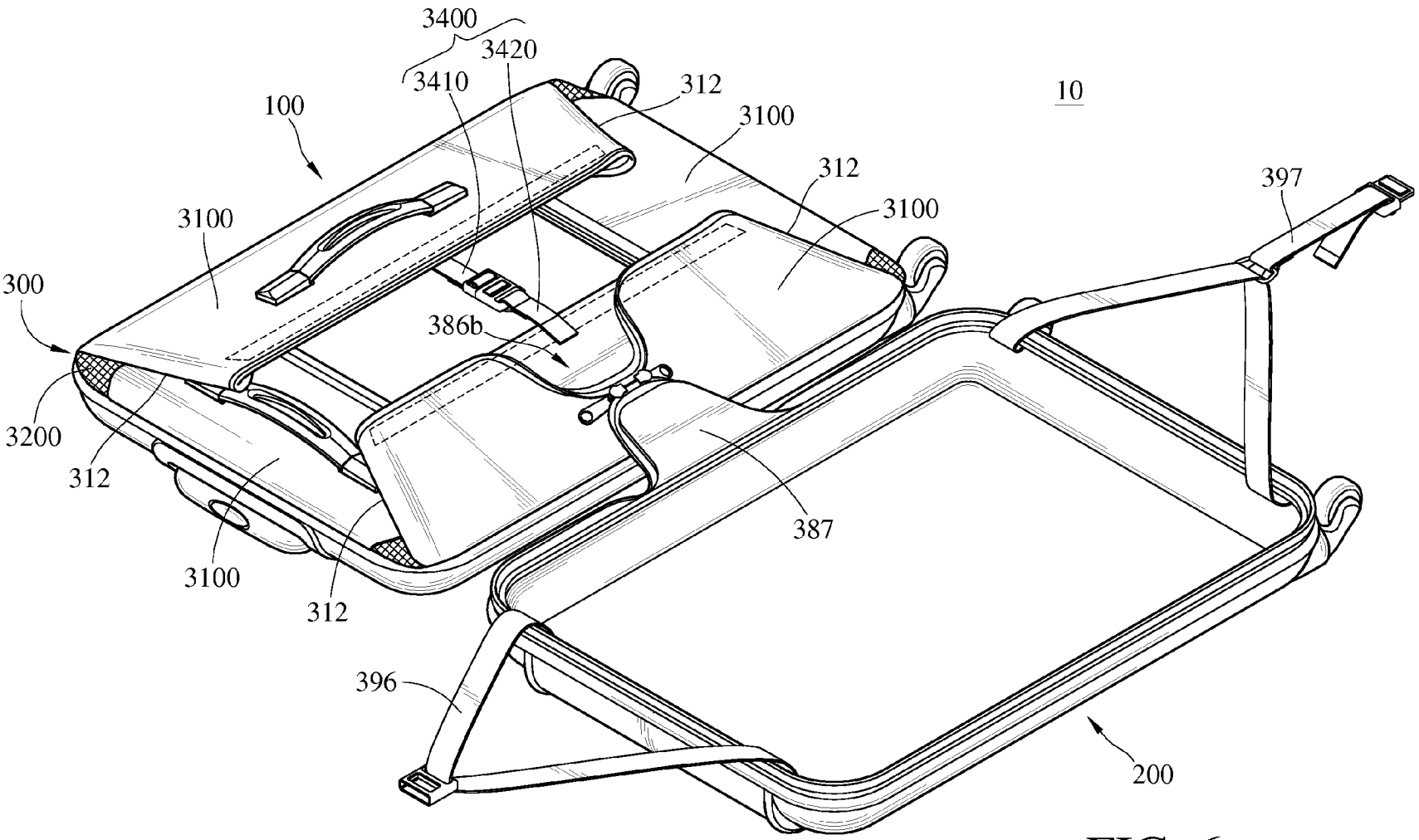

Subsequently, as seen in FIG. 6, the sidewall portions 3100 on the left and right sides are pressed inwardly, so that each sidewall portion 3100 is stacked on the back case component 100 and therefore is at the storage position. While the flexible structure 3200 is being bent, each sidewall portion 3100 near each flexible structure 3200 will bend to be stacked on another because of the flexible deformation capability of the flexible structure 3200. In addition, each sidewall portion 3100 generates a bending line 312 because of the force generated by the inward pressing. Then, connect the first strap body 3410 with the second strap body 3420, thereby fixing each sidewall portion 3100 to the storage position.

Figure 7:
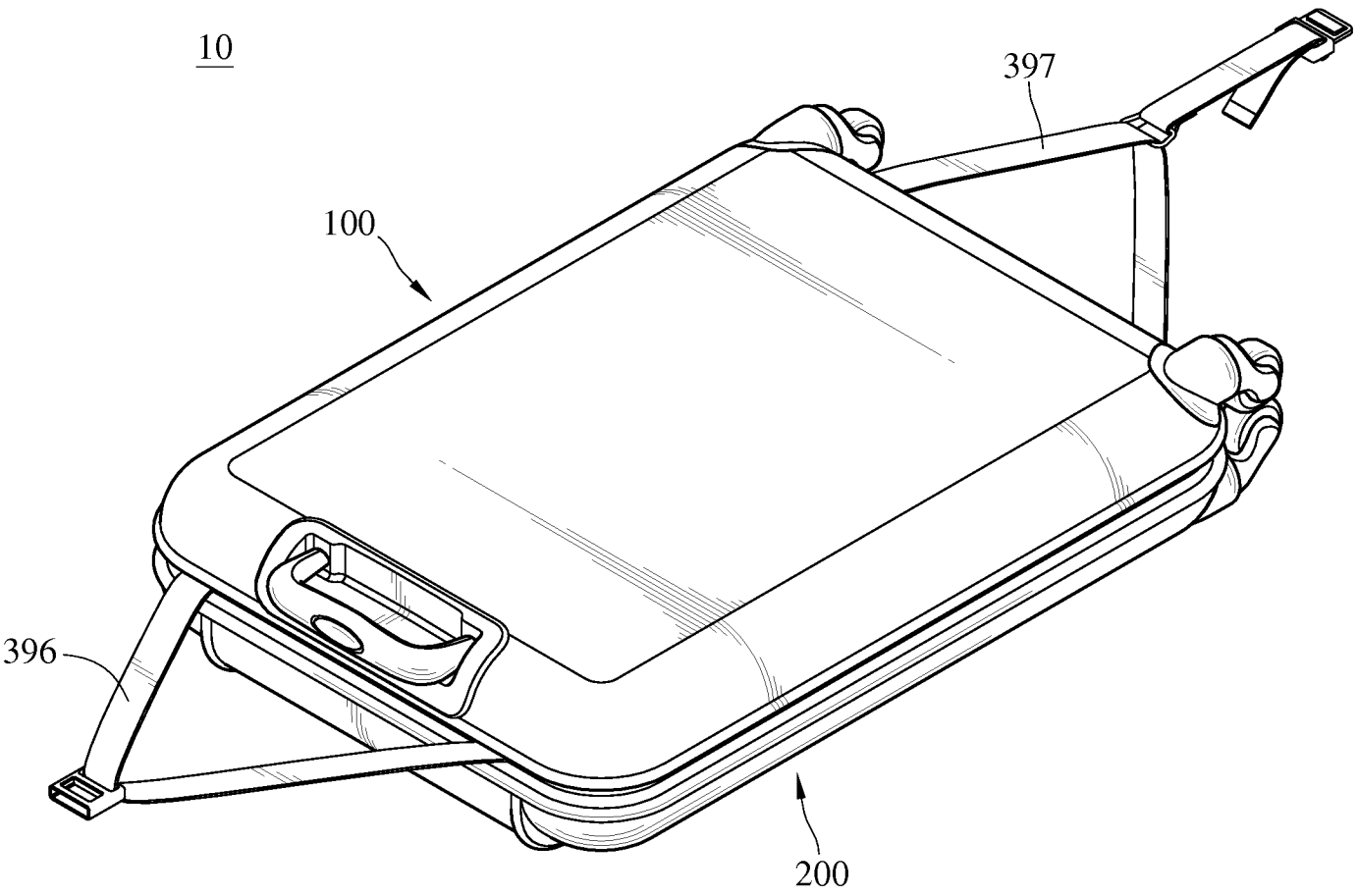
Figure 8:
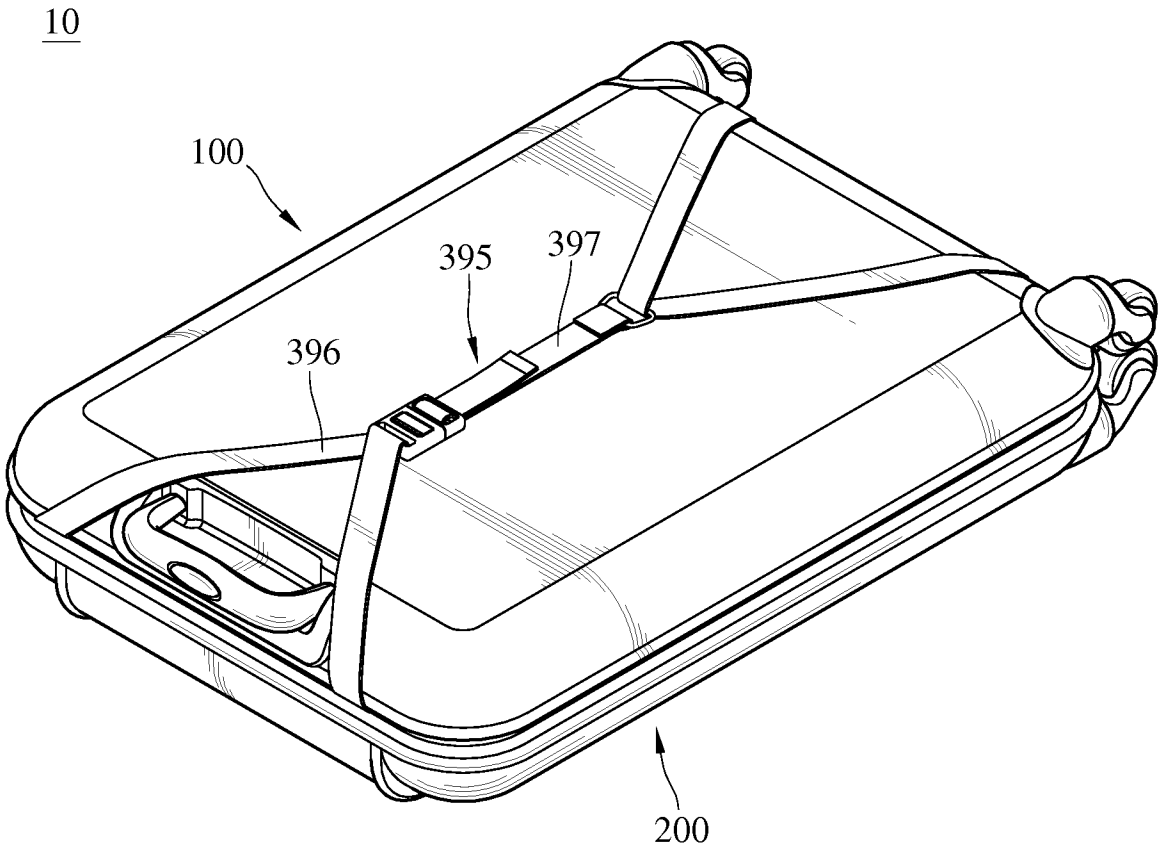

Then, as seen in FIG. 7, the back case component 100 and the stored ring-shaped gusset component 300 are stacked on the front lid component 200. In the final stage, as shown in FIG. 8, the first belt body 396 and the second belt body 397 are buckled up so that the back case component 100 and the front lid component 200 are tied together for finishing the storage process of the suit case structure 10. Further, comparing FIG. 8 with FIG. 1, it is obvious that the size of the suit case structure 10 in the storage position is much smaller than that of the suit case structure 10 in the use position.

Figure 9:
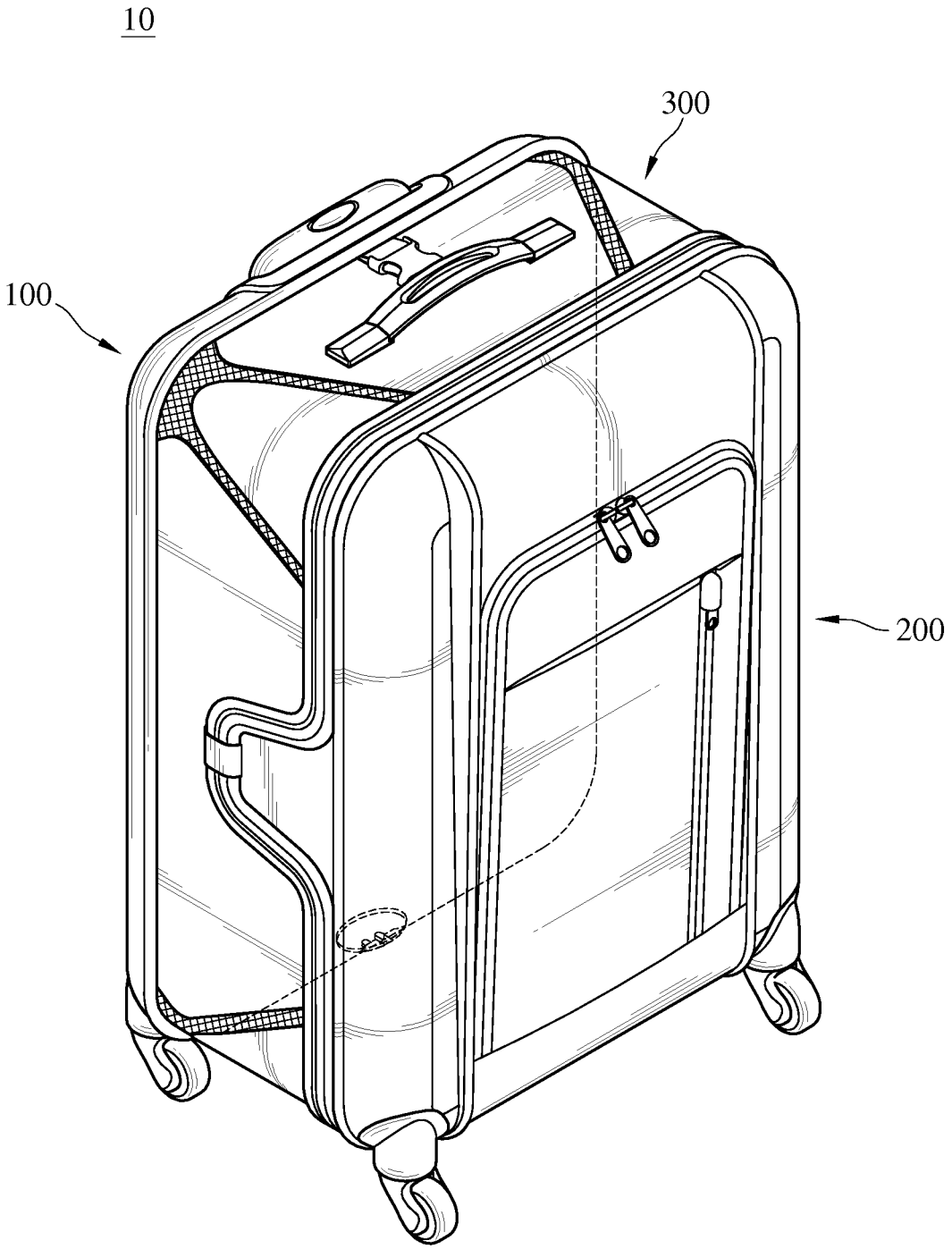
FIG. 9 is a perspective view of a suitcase structure according to the second embodiment of the disclosure.
Figure 10:
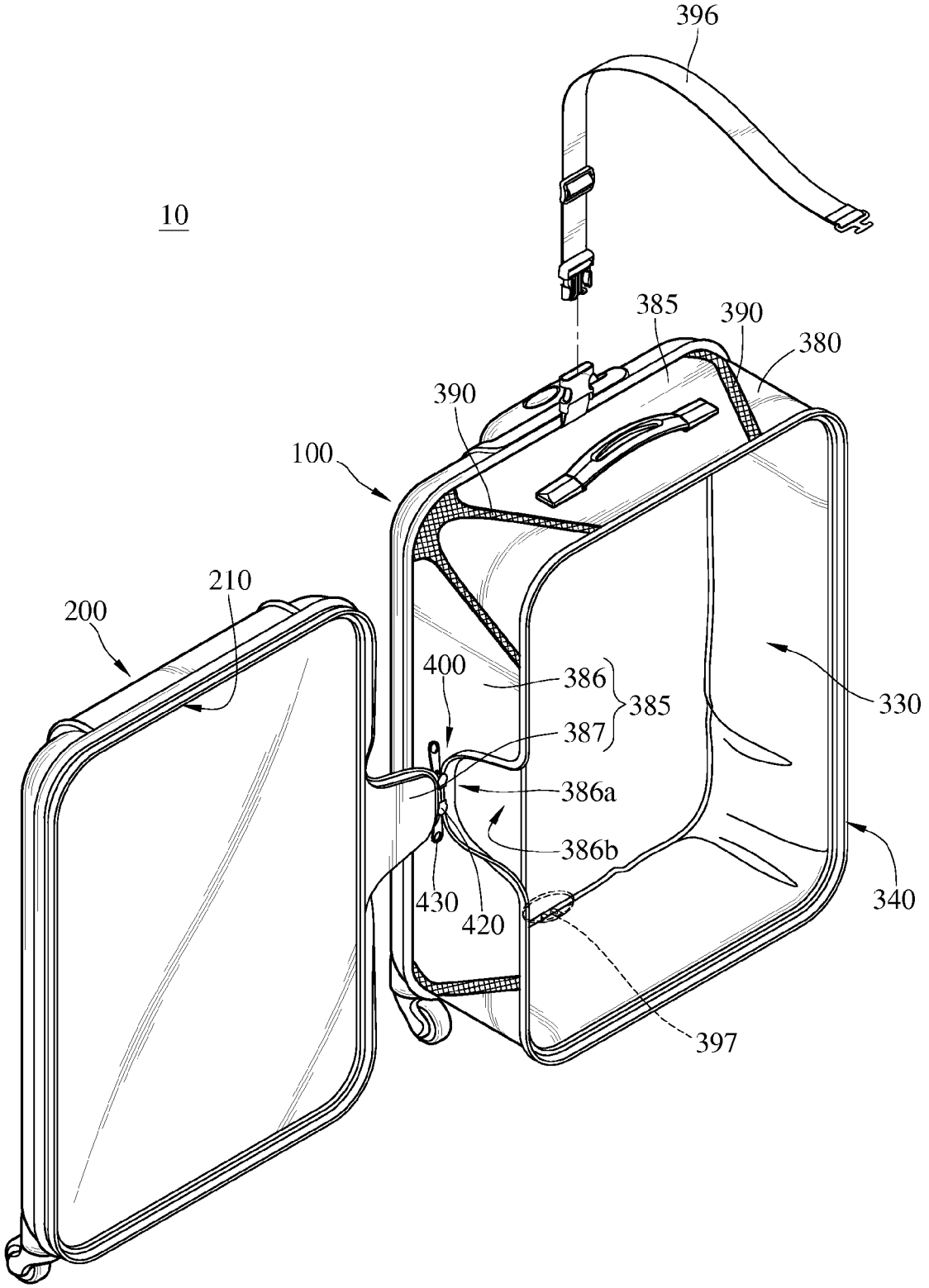
FIG. 10 is a perspective view of the opened suitcase in FIG. 9.

FIG. 9 is a perspective view of a suitcase structure according to the second embodiment of the disclosure; FIG. 10 is a perspective view of the opened suitcase in FIG. 9; and FIG. 11 is an enlarged view of the zipper part of FIG. 10.

Figure 11:
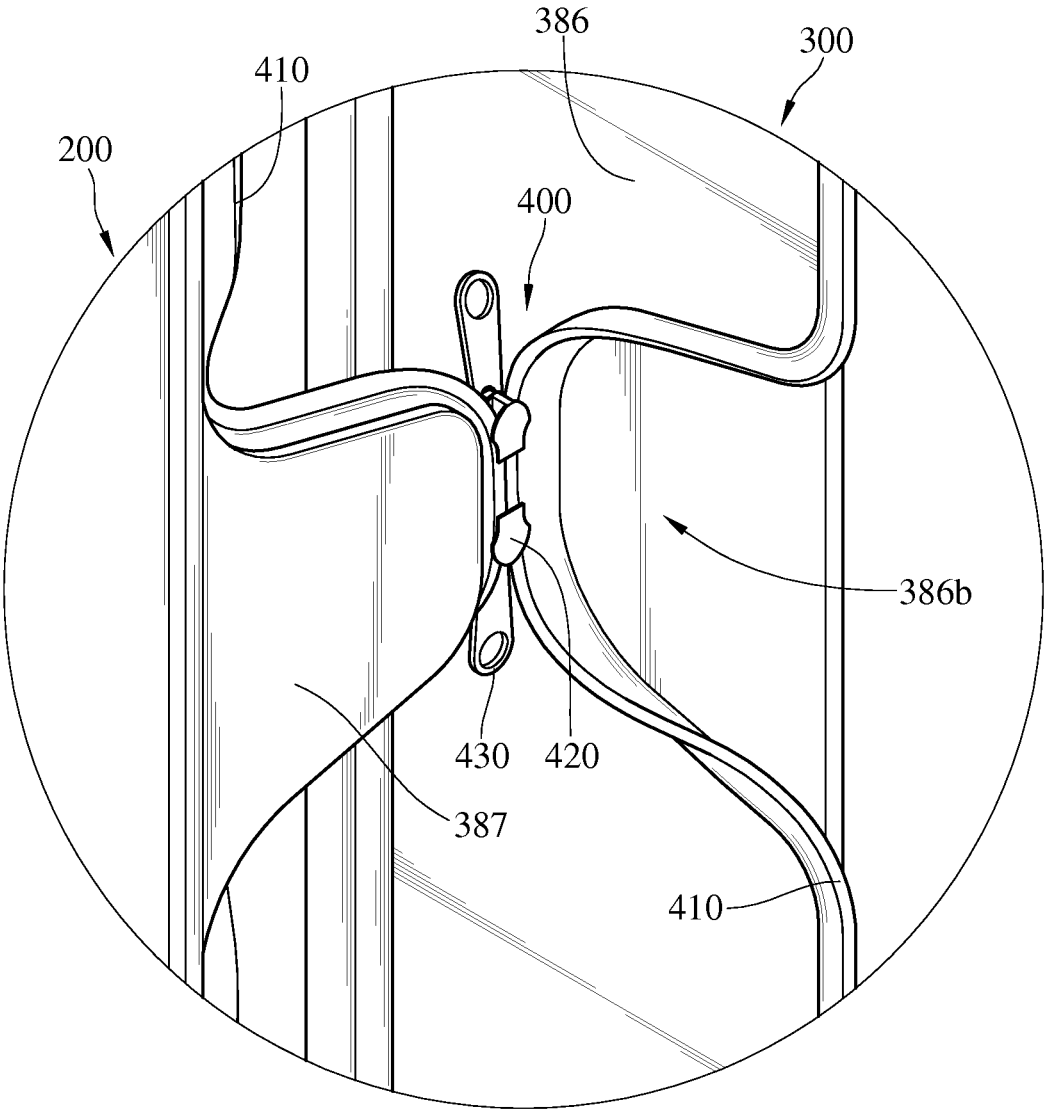
FIG. 11 is an enlarged view of the zipper part of FIG. 10.

As seen in FIG. 9 to FIG. 11, in this embodiment, a suitcase structure 10 comprises a back case component 100, a front lid component 200 and a ring-shaped gusset component 300. The back case component 100 and the front lid component 200 are made by relatively harder materials due to the better protection. For example, they are made by plastic plates such as polyethylene (PE), polypropylene (PP), ethylene-vinyl acetate (EVA), polyvinyl chloride (PVC) or acrylonitrile butadiene styrene (ABS) resin, or made by fabrics.

The opposite two sides of the ring-shaped gusset component 300 are connected to the edge of the back case component 100 and the edge of the front lid component 200 respectively, in order to form an accommodating space 330. Additionally, in this embodiment, the ring-shaped gusset component 300 is made by composite materials. For example, it can be made by relatively harder materials such as 1268D cloth, PE, PVC, PP, EVA or ABS and relatively softer materials such as cane cloth, styrene-butadiene rubber (SBR), 150D jersey, polyurethane (PU), rubber, thermoplastic polyurethane (TPU), Sandwich Mesh Fabric, neoprene, polyester, thermoplastic rubbers (TPR), webbing, or leather. Moreover, in this embodiment, the ring-shaped gusset component 300 has a plurality of first supporting parts 380 and a plurality of second supporting parts 385, which are connected with each other. Each of the first supporting parts 380 is located at each of the end corners of the back case component 100, while each of the second supporting parts 385 is located at each of lateral edges of the back case component 100.

The inner material of the first supporting part 380 and the second supporting part 385 is, for example, the iron wire frame, the wood plate, the plastic plate, the iron plate, the aluminum plate or the magnesium alloy plate.

The ring-shaped gusset component 300 comprises a plurality of bending parts 390. Each of the bending parts is located between the first supporting part 380 and the second supporting part 385 which are adjacent to each other, and extends from the back case component 100 to the front lid component 200. In other words, two opposite sides of each of the bending parts 390 are connected to the first supporting part 380 and the second supporting part 385 respectively. Furthermore, the flexible deformation capability of each of the bending parts 390 is greater than that of each of the first supporting parts 380 and of each of second supporting parts 385. Additionally, the bending parts 390 are bendable, so as to make the plurality of first supporting parts 380 and the plurality of second supporting parts 385 be capable of being stacked oppositely or being erected on the back case component 100, thereby having a storage position and a use position.

In this embodiment, the first supporting part 380 is, but not limited to, made by a PVC layer 810, an EVA layer 820, a PP plate layer 830, a cane cloth layer 840, a neoprene layer 850 and a PVC bottom layer 860, which are staked up. The second supporting part 385 is, but not limited to, made by a PVC layer 810, an EVA layer 820 and a PP plate layer 830. Moreover, each of the bending parts is disposed between the first supporting part 385 and the second supporting part 390 which are adjacent to each other. The bending part is, but not limited to, made by a cane cloth layer 840, a neoprene layer 850 and a PVC base fabric layer 860. Since the flexible deformation capability of the cane cloth layer 840, the neoprene layer 850 and the PVC base fabric layer 860 is greater than that of the PVC layer 810 and PP plate layer 830, and the cane cloth layer 840, the neoprene layer 850 and the PVC base fabric 860 are bendable, the plurality of first supporting parts 380 and the plurality of second supporting parts 385 can be movably stacked oppositely or erected on the back case component 100, and thereby having a storage position and a use position. The cane cloth player 840 is made by, for example, styrene-butadiene rubber. In this and some other embodiments, a PVC film is attached to the aforementioned PVC base fabric 860. Additionally, in this embodiment, the plate layer 830 is stitched to inside of the first supporting part 385 and the second supporting part 390, but the disclosure is not limited thereto. In other embodiments, the PP plate layer 830 may be movably disposed on the first supporting part 385 and the second supporting part 390.

Additionally, the ring-shaped gusset component 300 of this embodiment has a first opening 340, while the front lid component 200 has a second opening 210. One of the aforementioned second supporting parts 385 has a lateral part 386 and a linking part 387. The lateral part 386 has an outer wall 386*a* and a concave 386*b* located on the outer wall 386*a* of the lateral part 386. A lateral edge of the linking part 387 is connected to the edge of the lateral part 386 which forms the concave 386*b*, while the opposite lateral edge of the linking part 387 is connected to the edge of the second opening 210 of the front lid component 200. That is, the linking part 387 connects the front lid component 200 with the lateral part 386 and is between them.

Furthermore, a zipper 400 is installed on the ring-shaped gusset component 300 to form an accommodation space 330. The zipper 400 comprises two chains 410, two zipper heads 420 and two zipper pieces 430. One of the chains 410 is disposed around the edge of the first opening 340 and the edge of the concave 386*b*, while the other of the chains 410 is disposed around the edge of the second opening 210 and the edge of the linking part 387. The two zipper heads 420 can join the two chains 410 together or separate them from each other for closing or opening the suitcase structure 10, thereby making the linking part 387 cover the lateral part 386 or be away from the lateral part 386. The two zipper pieces 430 are movably disposed on the zipper heads 420 and are out of the accommodation space 330. In this embodiment, the number of the zipper heads 420 is two, but this is not intended to limit the disclosure. In other embodiment, the number of the zipper heads 420 can be just one. The zipper 400 of this embodiment is one of the means of connecting the front lid component with the ring-shaped gusset component 300, while in other embodiments, Velcro and buttons may be used for connecting them.

In this and some other embodiments, the ring-shaped gusset component 300 further comprises a belt 395. The belt 395 comprises a first belt body 396 and a second belt body 397. The first belt body 396 is detachably disposed on the outer lateral side of the ring-shaped gusset component 300, and the second belt body 397 is disposed on the outer lateral side of the ring-shaped gusset component 300 respectively, but the disclosure is not limited thereto. In other embodiments, they can be disposed on the inner lateral side of the ring-shaped gusset component 300. Or, in other embodiments, the first belt body 396 is directly connected to the outer lateral side of the ring-shaped gusset component 300, namely not detachable. When the first belt body 396 and the second belt body 397 are connected to each other, each of the first supporting parts 380 and each of the second supporting parts 385 are fixed to the storage position. Moreover, in this embodiment, the first belt body 396 and the second belt body 397 are disposed on the upper side and lower side of the ring-shaped gusset component 300 respectively, but the disclosure is not limited thereto. In other embodiment, the first belt body 396 and the second belt body 397 may be disposed on the left side and the right side of the ring-shaped gusset component 300 respectively.

Furthermore, in this and some other embodiments, the suitcase structure 10 further comprises a gripping part 930. The gripping part 930 is connected to the second extending part 230. The griping part 930 is configured for allowing users to grip it with one hand in order to fix the position of the second extending part 230. Thereby, users may use the other hand to drag the zipper head 420. However, in other embodiments, the gripping part 930 may be connected to the first extending part 398, and the disclosure is not limited thereto.

The storage process of the suitcase structure of this embodiment is illustrated in to FIG. 10 and FIG. 12 to FIG. 15, in which FIG. 12 to FIG. 15 are schematic views of the storage process of FIG. 10.

Figure 12:
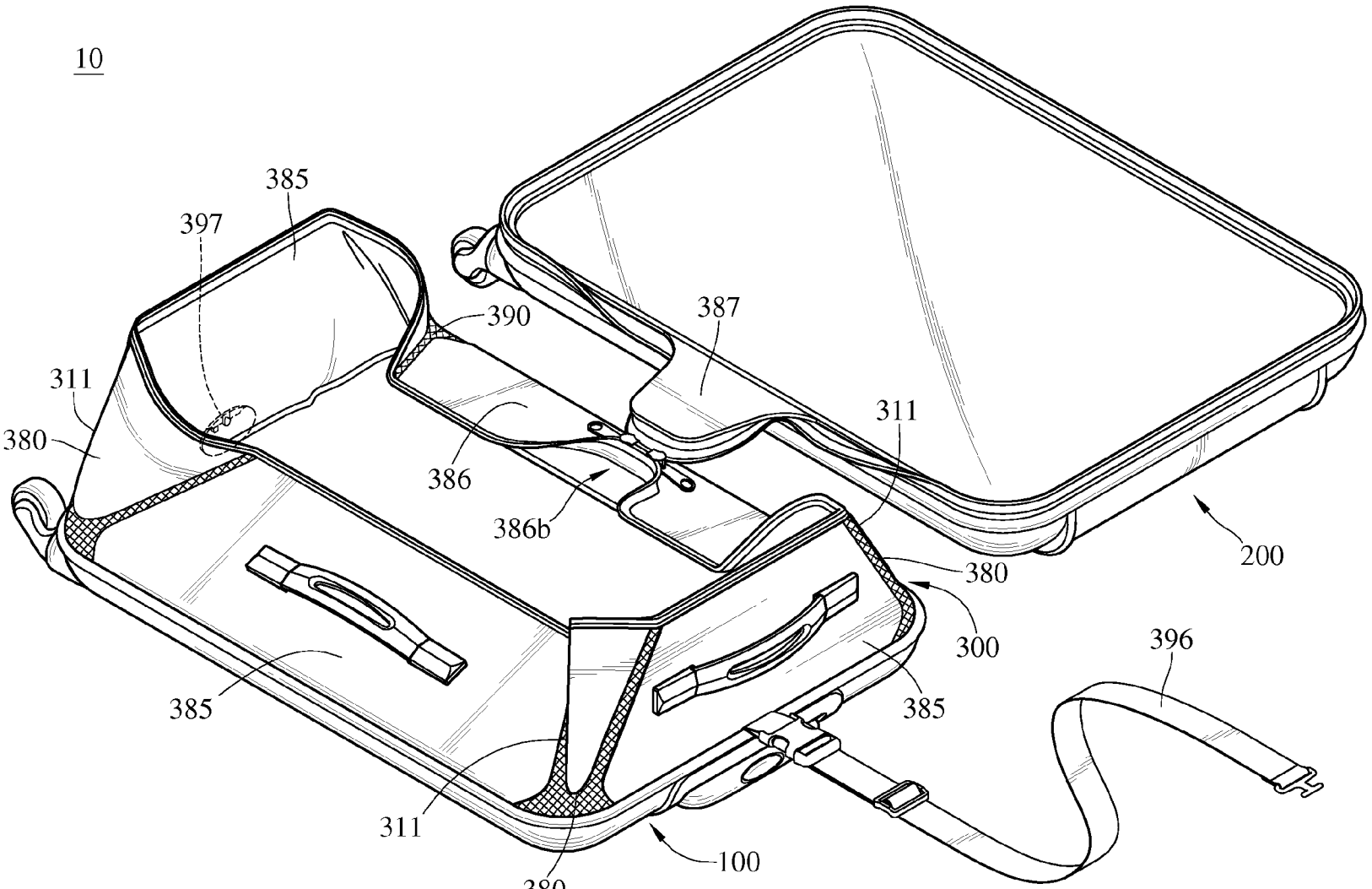
FIG. 12 to FIG. 15 are schematic views of the storage process of FIG. 10.

Firstly, according to FIG. 10, the ring-shaped gusset component 300 is erected oppositely on the back case component 100 and therefore is in a use position. At this point, goods can be stored in the accommodating space 300. Subsequently, the action of folding the ring-shaped gusset component 300 starts. As shown in FIG. 12, the two opposite second supporting parts 385 are first pressed inwardly to form the fold line 311.

Figure 13:
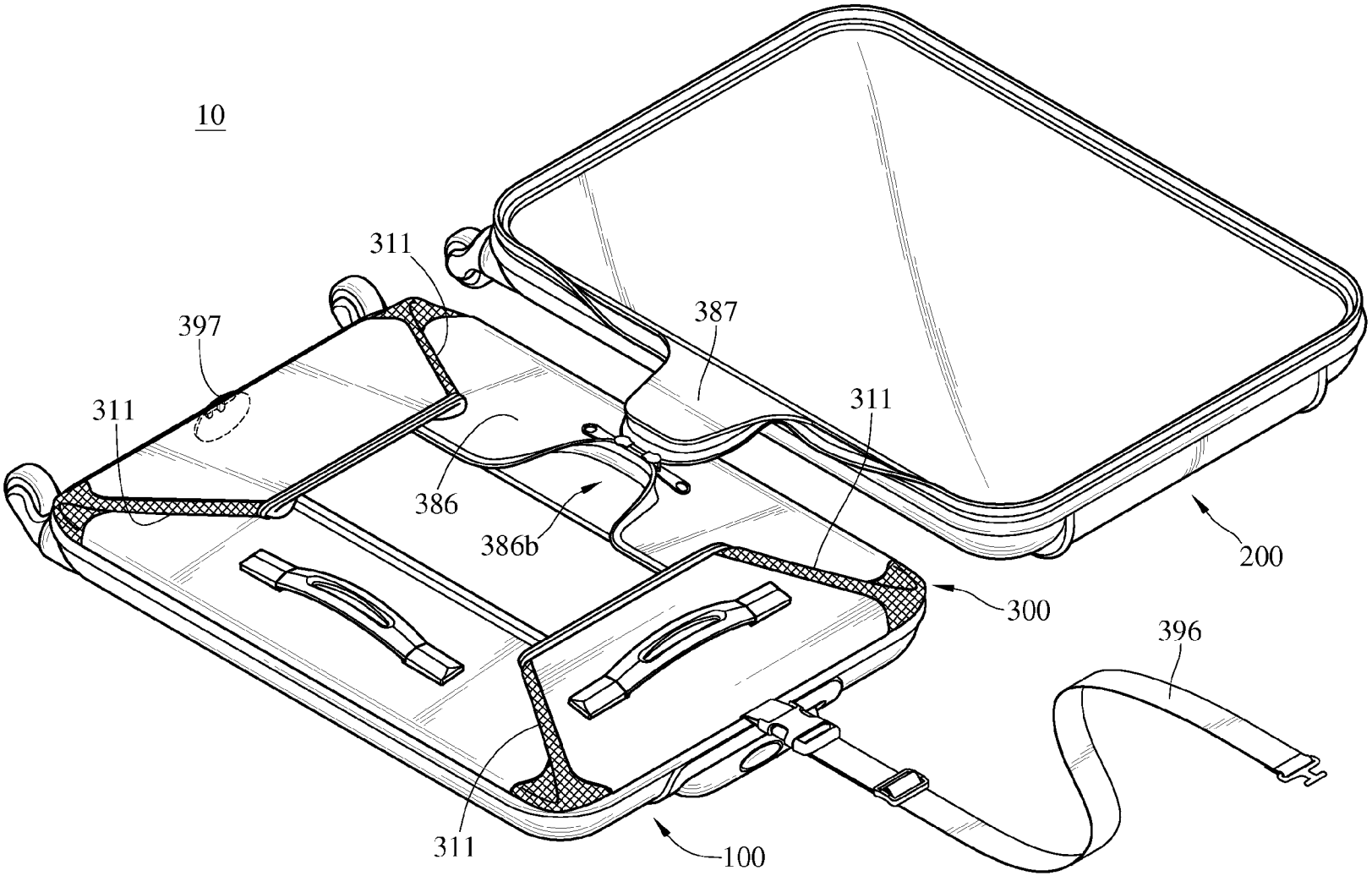
Figure 14:
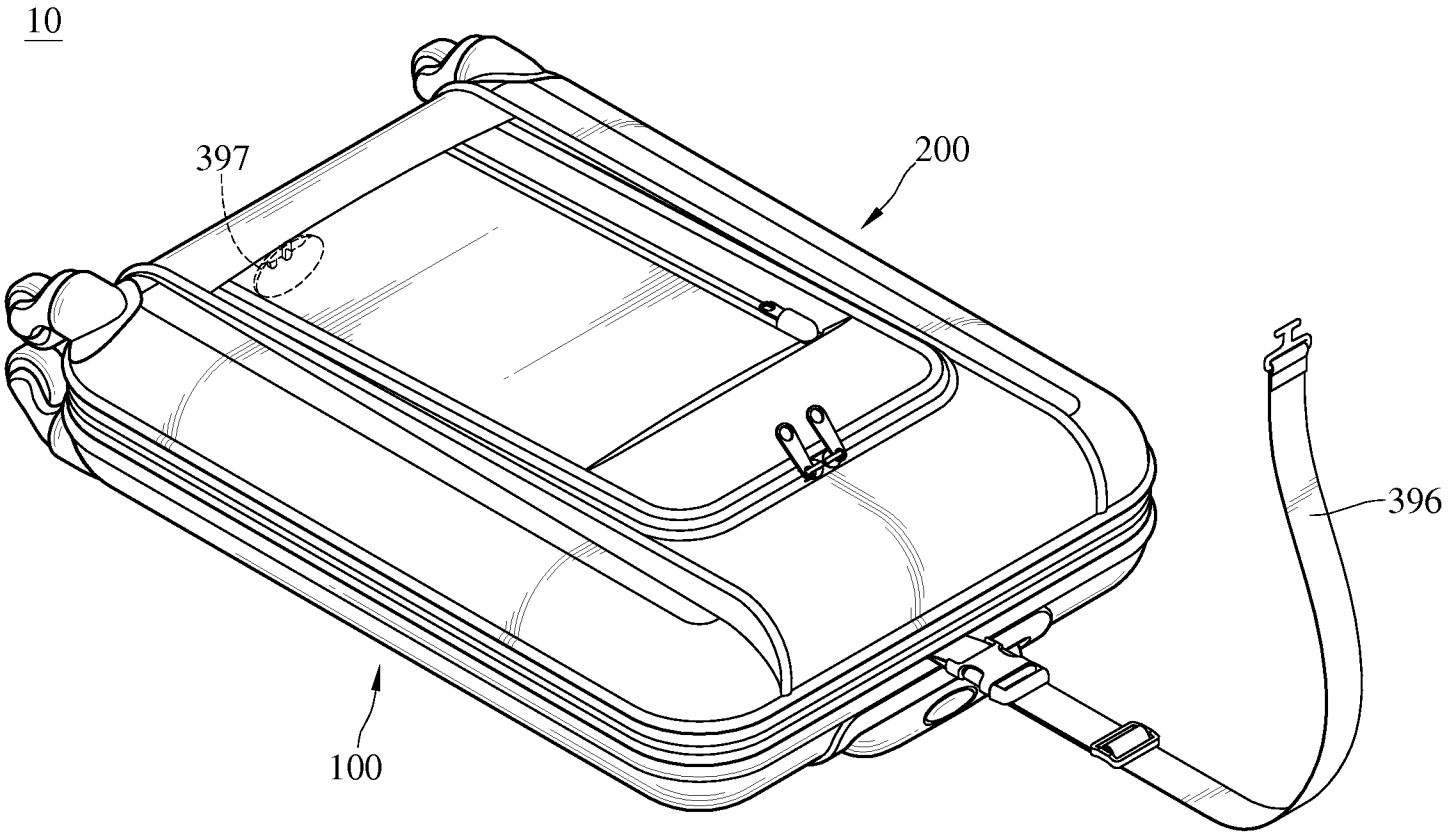
Figure 15:
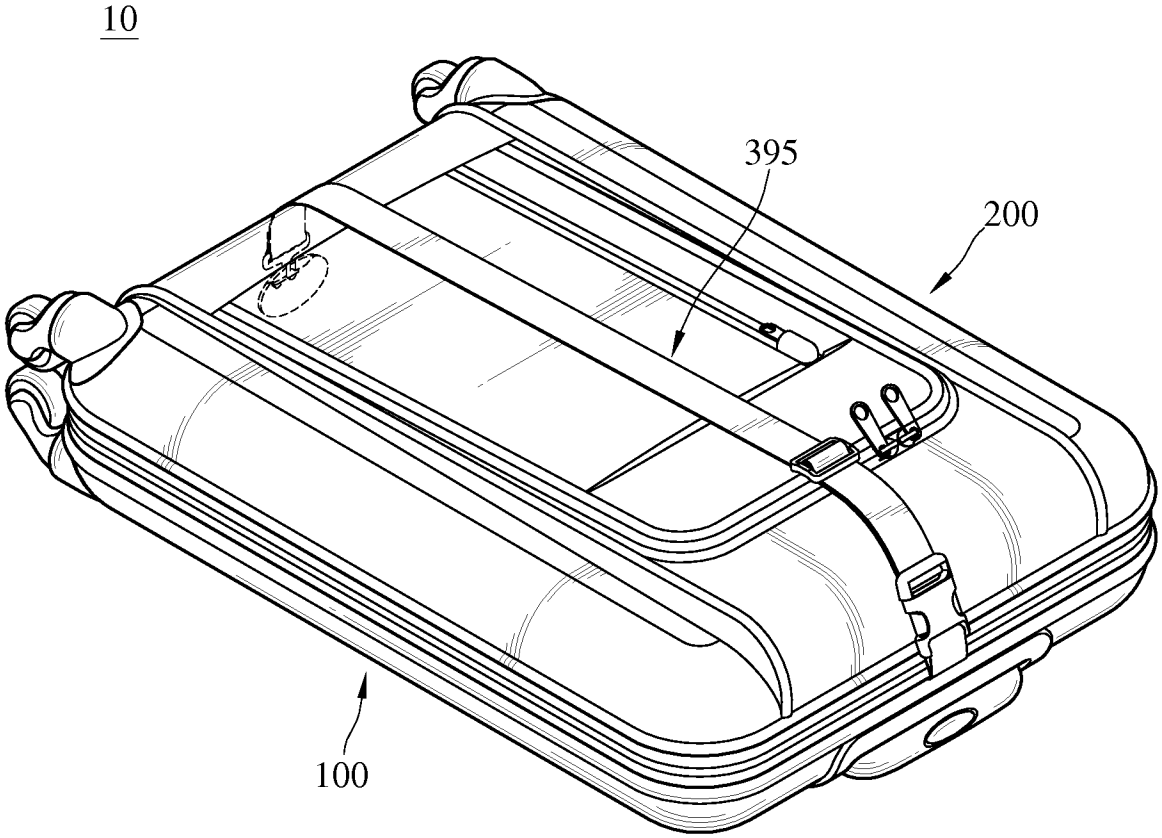

Then, as shown in FIG. 13, the rest two opposite second supporting parts 385 are folded inwardly, so as to stack each of the first supporting parts 380 and each of the second supporting parts 385 on the back case component 100 to be in the storage position. Subsequently, as shown in FIG. 14, the front lid component 200 is stacked on the back case component 100 and the ring-shaped gusset component 300 which has already been stored. Additionally, each of the first supporting parts 380 and each of the second supporting parts 385 are fixed to the storage position. Lastly, as shown in FIG. 15, the first belt body 396 and the second belt body 397 are buckled up to tie the back case component 100 and the front lid component 200 together. As a result, the storage process of the suitcase structure is finished. Moreover, by comparing FIG. 15 to FIG. 9, it is found that the size of the suitcase structure 10 in the storage position is significantly smaller than that of the suitcase structure 10 in the use position.

Furthermore, while folding the suit case structure 10, the linking part 387 is bending relative to lateral part 386 and is moving away from the outer wall surface of the lateral part 386. Thereby, this can increase the distance between the front lid component 200 and the second supporting part 385, so as to ensure that the front lid component 200 does not interfere with the folding process of the suit case structure 10.

Moreover, by the design of the lateral part 386 and the linking part 387, the zipper piece 430 can be separately placed at the position out of the accommodation space 330. Thereby, when opening the front lid component 200, the user can externally operate the zipper piece 430 to separate two chains 410 completely.

Aforementioned concave 386*b* does not run through the second supporting part 386, but the disclosure does no limited thereto. In other embodiments, the concave 386*b* can penetrate the second supporting part 386.

Figure 16:
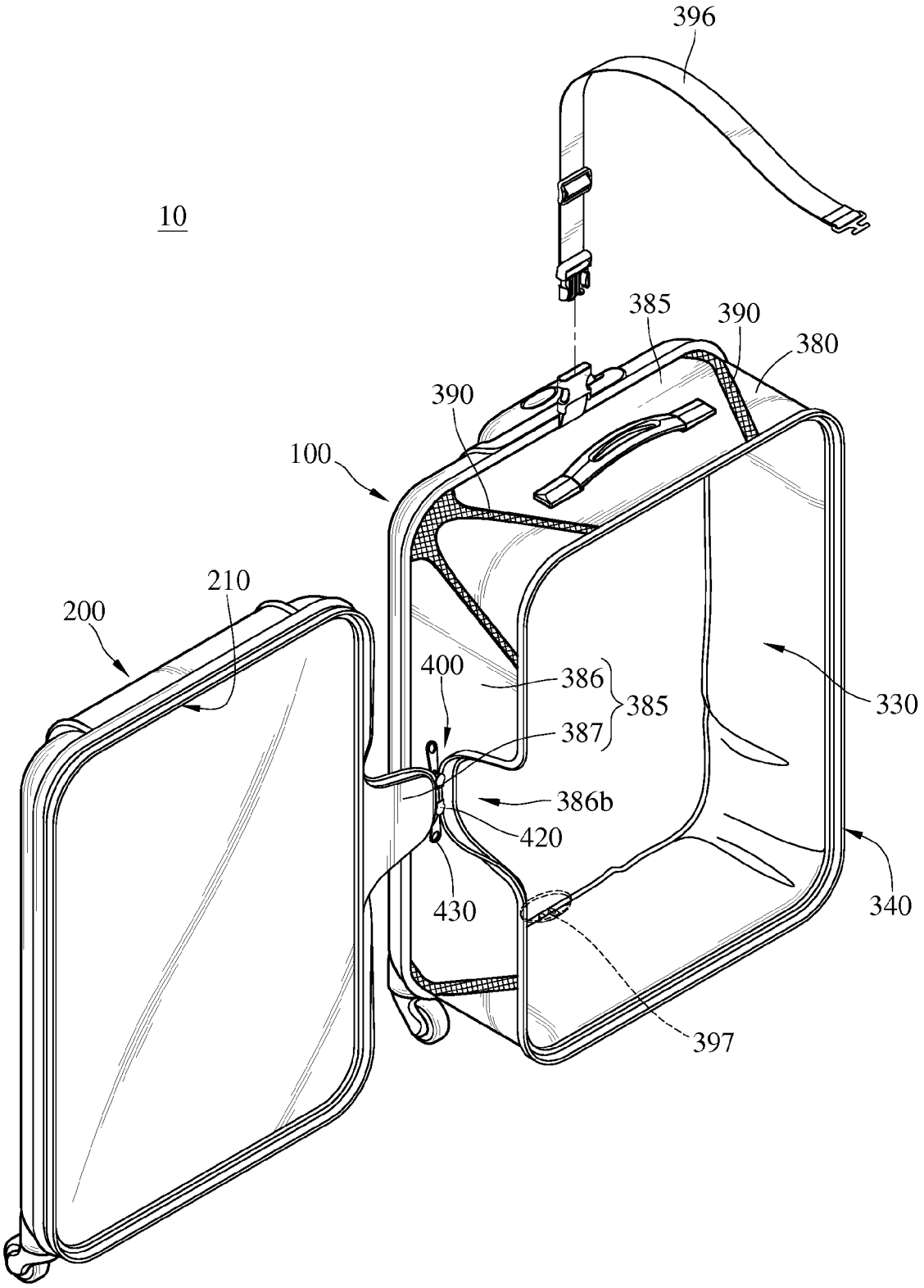
FIG. 16 is a perspective view of an opened suitcase structure according to the third embodiment of the disclosure.

FIG. 16 is a perspective view of an opened suitcase structure according to the third embodiment of the disclosure. This embodiment is similar to that of FIG. 9, so only the differences between them will be illustrated.

As seen in FIG. 16, in this embodiment, the ring-shaped gusset component 300 has a first opening 340, and the front lid component 200 has a second opening 210. One of the second supporting parts 385 has a lateral part 386 and a linking part 387. The lateral part 386 has a concave 386*b* located on the edge of the first opening 340. A lateral edge of the linking part 387 is connected to the edge of the lateral part 386 which forms the concave 386*b*, while the opposite lateral edge of the linking part 387 is connected to the edge of the second opening 210 of the front lid component 200. The zipper 400 comprises two chains 410, two zipper heads 420 and two zipper pieces 430. One of the chains 410 is disposed around the edge of the first opening 340 and the edge of the concave 386*b*, while the other of the chains 410 is disposed around the edge of the second opening 210 and the edge of the linking part 387. The two zipper heads 420 can join the two chains 410 together or separate them from each other. The zipper head 420 close the two chains 410 to make the linking part 387 and the lateral part 386 together form one of the second supporting parts 385.

Figure 17:
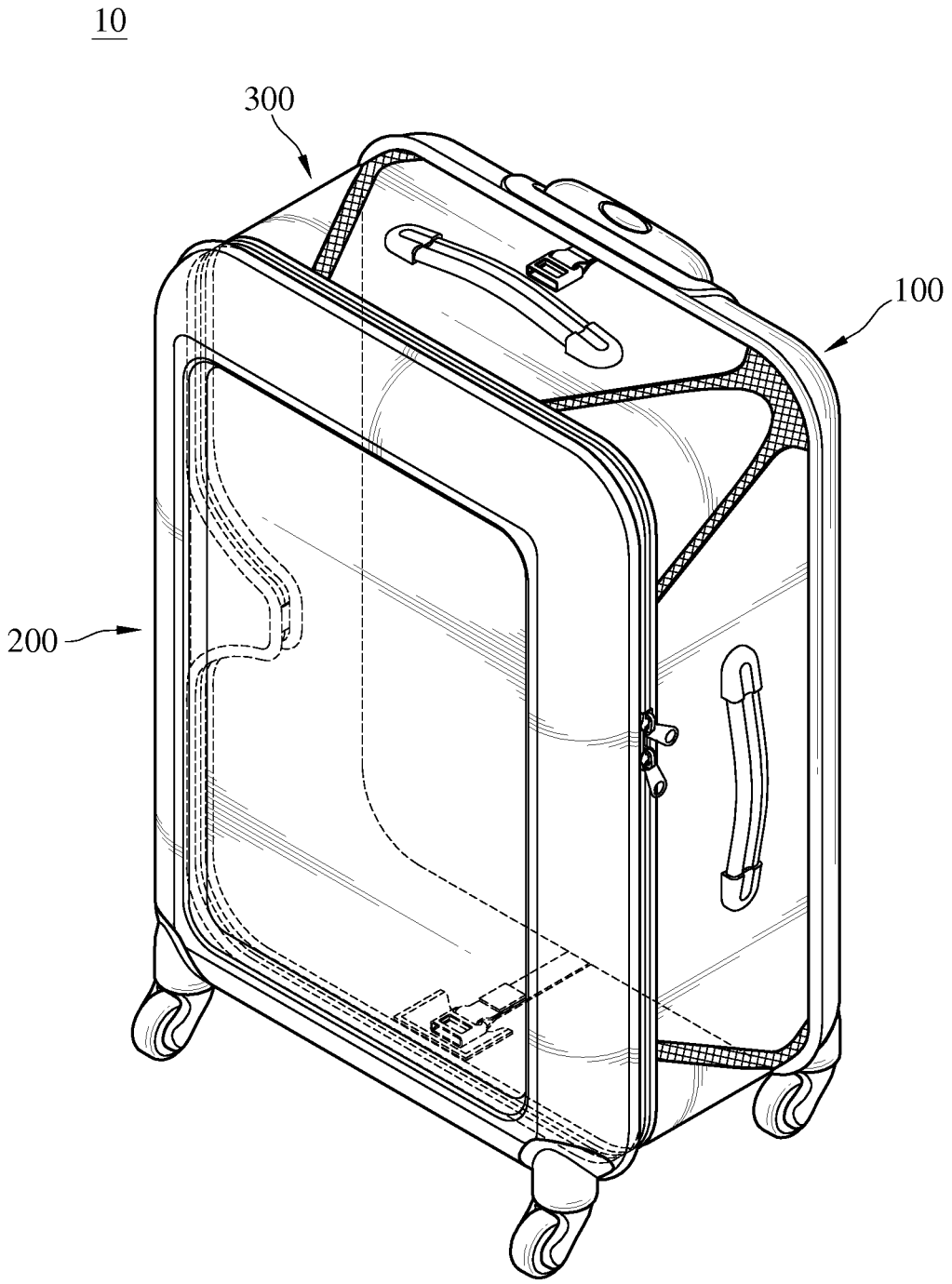
FIG. 17 is a perspective view of a suitcase structure according to the fourth embodiment of the disclosure.
Figure 18:
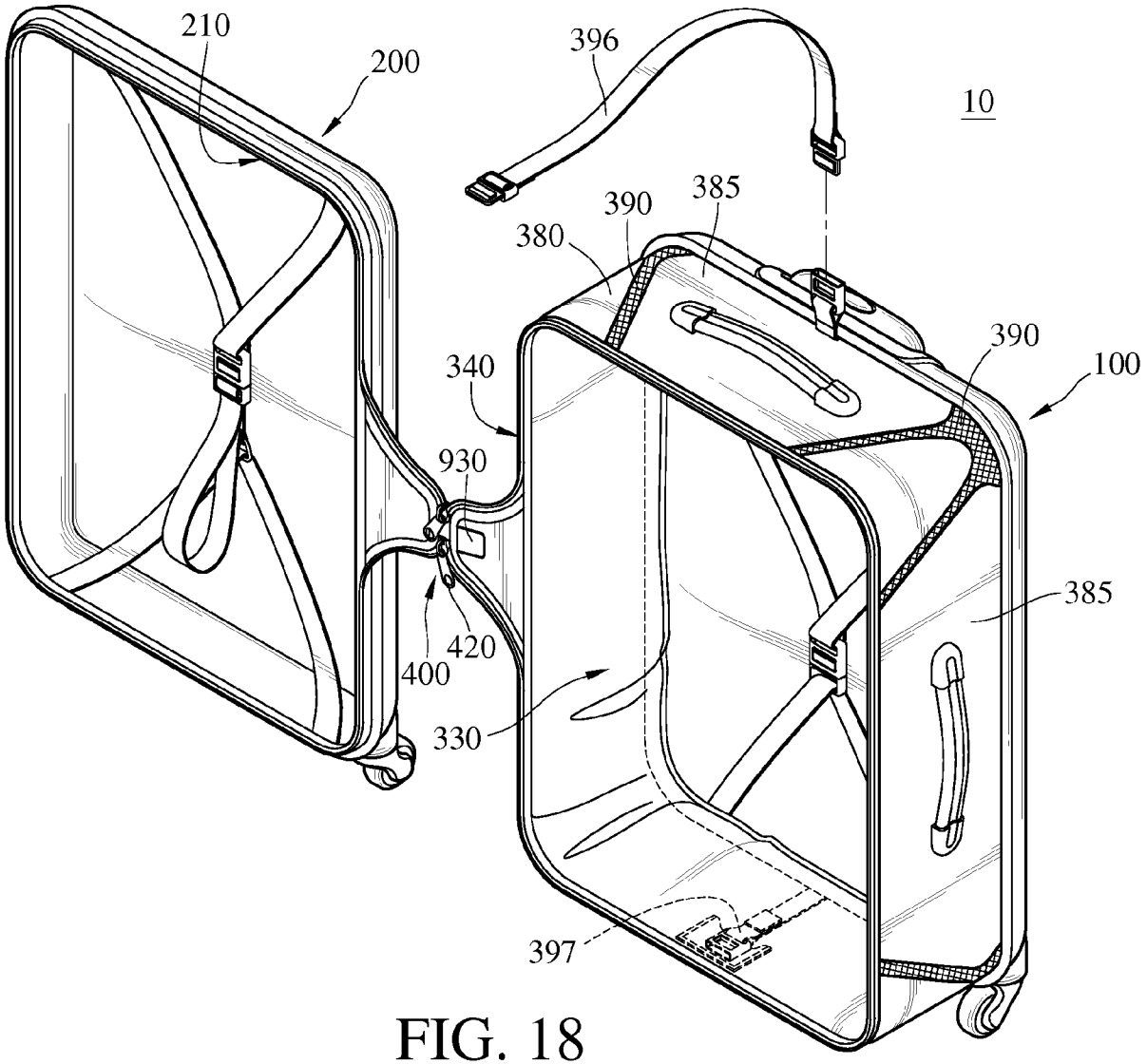
FIG. 18 is a perspective view of the opened suitcase in FIG. 17.
Figure 19A:
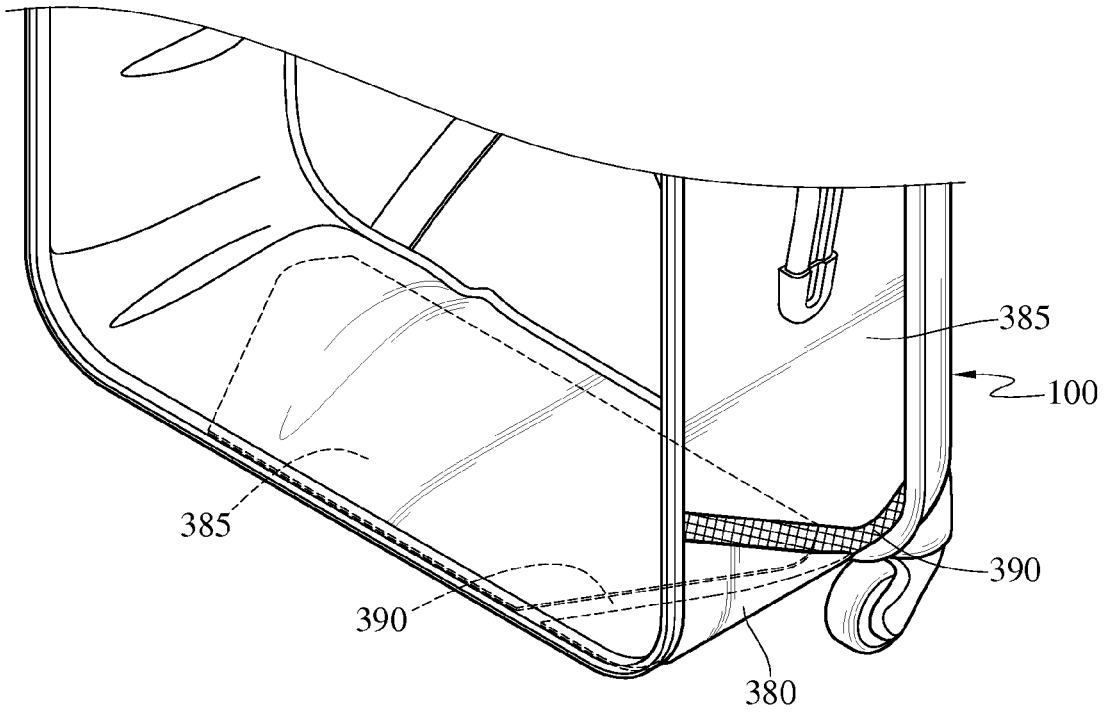
FIG. 19A is a partial enlarged view of FIG. 18.
Figure 19B:
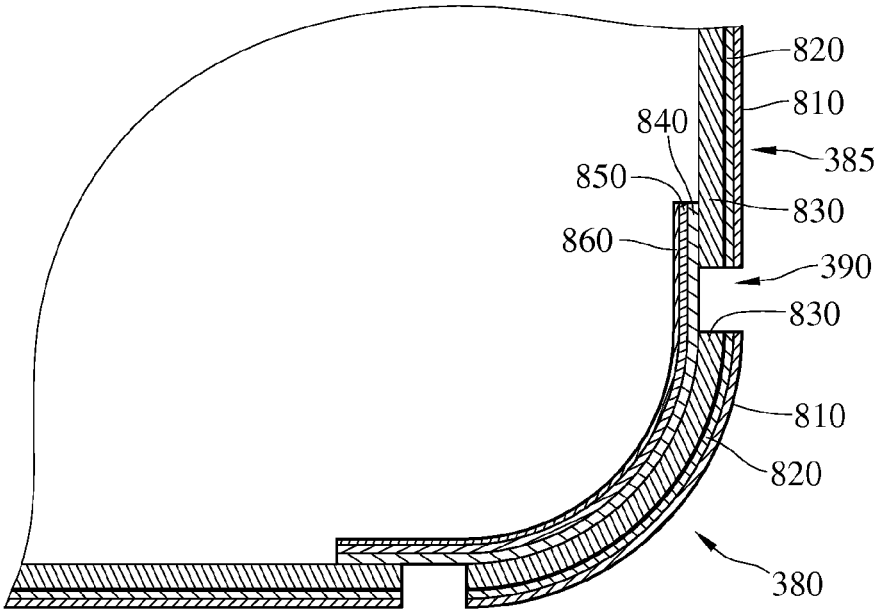
FIG. 19B is a cross section view of FIG. 19A.
Figure 19C:
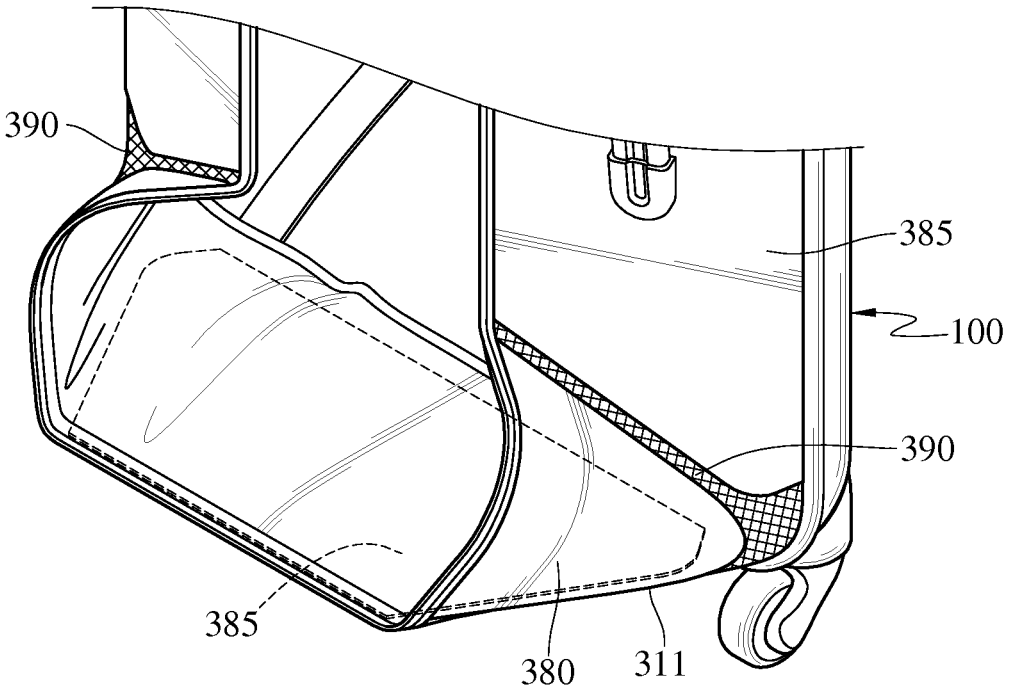
FIG. 19C is perspective view of FIG. 19A after being bended.
Figure 20:
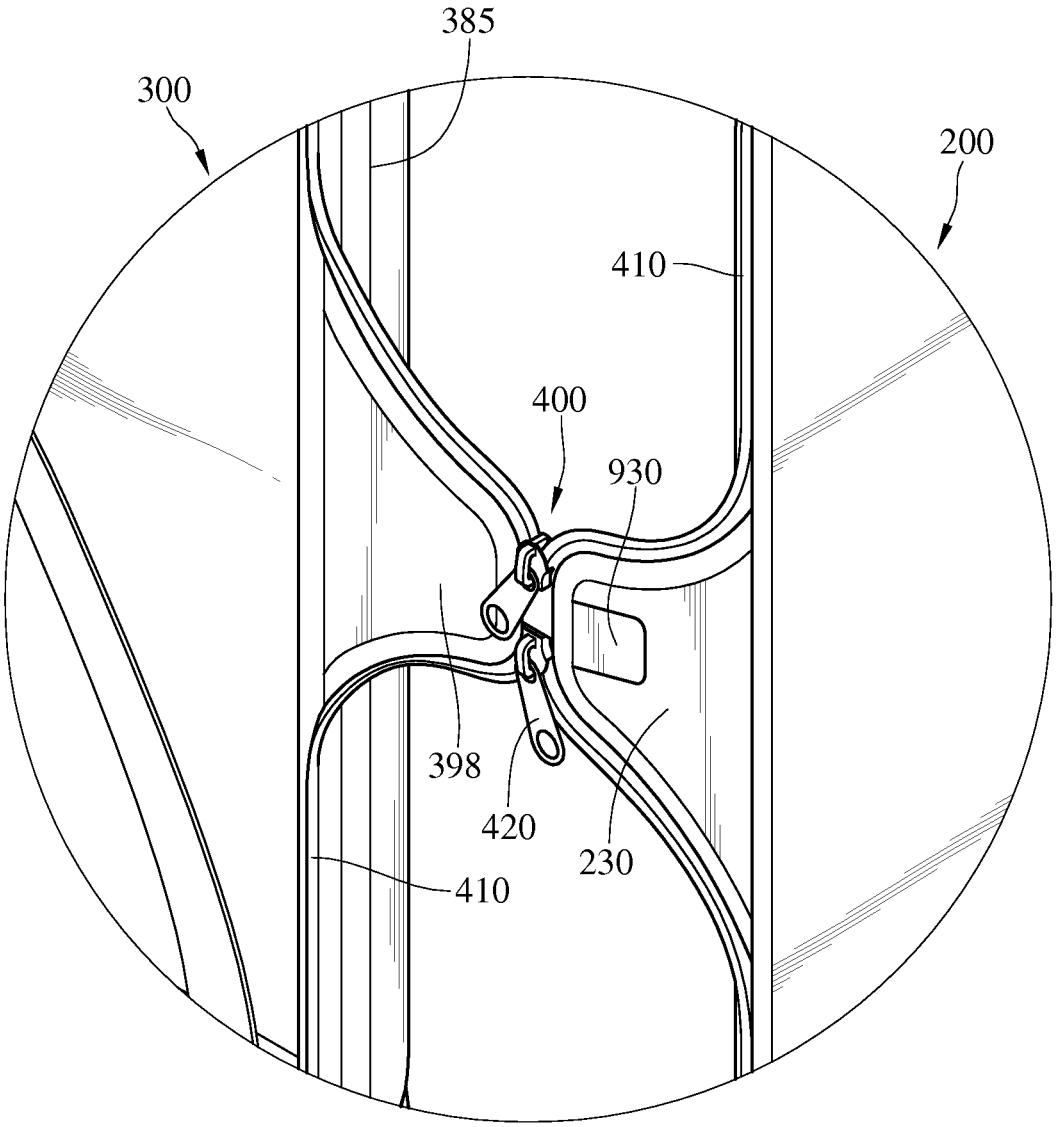
FIG. 20 is an enlarged view of the zipper part of FIG. 18.

Please refer to FIG. 17 to FIG. 20. FIG. 17 is a perspective view of a suitcase structure according to the fourth embodiment of the disclosure. FIG. 18 is a perspective view of an opened suitcase structure of FIG. 17. FIG. 19A is a partial enlarged view of FIG. 18. FIG. 19B is a cross section view of FIG. 19A. FIG. 19C is perspective view of FIG. 19A after being bended. FIG. 20 is an enlarged view of the zipper part of FIG. 18.

In this embodiment, a suitcase structure 10 comprises a back case component 100, a front lid component 200 and a ring-shaped gusset component 300. The back case component 100 and the front lid component 200 are made by relatively harder materials due to the better protection. For example, they are made by plastic plates such as polyethylene (PE), polypropylene (PP), ethylene-vinyl acetate (EVA), polyvinyl chloride (PVC) or acrylonitrile butadiene styrene (ABS) resin, or made by fabrics.

The opposite two sides of the ring-shaped gusset component 300 are connected to the edge of the back case component 100 and the edge of the front lid component 200 respectively, to form an accommodating space 330. Specifically, in this embodiment, the ring-shaped gusset component 300 is made by composite materials, for example, the combination of plastic plates such as PE, PVC, PP, EVA or ABS and relatively softer materials such as polyurethane (PU), rubber, thermoplastic polyurethane (TPU), Sandwich Mesh Fabric, neoprene, polyester, thermoplastic rubbers (TPR), webbing, or leather. In detail, the ring-shaped gusset component 300 has a plurality of first supporting parts 380 and a plurality of second supporting parts 385, which are connected with each other. Each of the first supporting parts 380 is located at each of the end corners of the back case component 100, while each of the second supporting parts 385 is located at each of lateral edges of the back case component 100. The inner material of the first supporting part 380 and the second supporting part 385 is, for example, the iron wire frame, the wood plate, the plastic plate, the iron plate, the aluminum plate or the magnesium alloy plate.

The ring-shaped gusset component 300 comprises a plurality of bending parts 390. Each of the bending parts is located between the first supporting part 380 and the second supporting part 385 which are adjacent to each other, and extends from the back case component 100 to the front lid component 200. In other words, two opposite sides of each of the bending parts 390 are connected to the first supporting part 380 and the second supporting part 385 respectively. Furthermore, the flexible deformation capability of each of the bending parts 390 is greater than that of each of the first supporting parts 380 and of each of second supporting parts 385. Additionally, the bending parts 390 are bendable, so as to make the plurality of first supporting parts 380 and the plurality of second supporting parts 385 be capable of being stacked oppositely or being erected on the back case component 100, thereby having a storage position and a use position.

In this embodiment, the first supporting part 380 is, but not limited to, made by a PVC layer 810, an EVA layer 820, a PP plate layer 830, a cane cloth layer 840, a neoprene layer 850 and a PVC bottom layer 860, which are staked up. The second supporting part 385 is, but not limited to, made by a PVC layer 810, an EVA layer 820 and a PP plate layer 830. Moreover, each of the bending parts is disposed between the first supporting part 385 and the second supporting part 390 which are adjacent to each other. The bending part is, but not limited to, made by a cane cloth layer 840, a neoprene layer 850 and a PVC base fabric layer 860. Since the flexible deformation capability of the cane cloth layer 840, the neoprene layer 850 and the PVC base fabric layer 860 is greater than that of the PVC layer 810 and PP plate layer 830, and the cane cloth layer 840, the neoprene layer 850 and the PVC base fabric 860 are bendable, the plurality of first supporting parts 380 and the plurality of second supporting parts 385 can be movably stacked oppositely or erected on the back case component 100, and thereby having a storage position and a use position. The cane cloth player 840 is made by, for example, styrene-butadiene rubber. In this and some other embodiments, a PVC film is attached to the aforementioned PVC base fabric 860. Additionally, in this embodiment, the plate layer 830 is stitched to inside of the first supporting part 385 and the second supporting part 390, but the disclosure is not limited thereto. In other embodiments, the PP plate layer 830 may be movably disposed on the first supporting part 385 and the second supporting part 390.

In this embodiment, the ring-shaped gusset component 300 has a first opening 340, and the front lid component 200 has a second opening 210. The ring-shaped gusset component 300 further comprises a first extending part 398. The first extending part 398 is connected to the ring-shaped gusset component 300 to form the edge of the first opening 340. The front lid further comprises a second extending part 230, and the second extending part 230 is connected to the front lid component 200 to form the edge of the second opening 210. The front lid 200 is connected to the ring-shaped gusset component 300 by a zipper 400, so as to form the accommodating space 330. The zipper 400 comprises two chains 410 and two zipper heads 420. One of the two chains 410 is disposed around the edge of the first opening 340 and the edge of the first extending part 398. The other chain 410 is disposed around the edge of the second opening 210 and the edge of the second extending part 230. Two zipper heads 420 are configured for tying the two chains 410 together or separating them, so as to close or open the suitcase structure 10. The zipper head 420 may be the single pull tab or the double pull tab, and it is not limited thereto. In this embodiment, the zipper head 420 is the double pull tab, and users may pull the inside tab or the outside tab based on the requirements to tying the two chains 410 together or separating them. Nonetheless, the zipper 400 is just one of the connection structures between the front lid component 200 and the ring-shaped gusset component 300. In other embodiments, the connection structure may be a Velcro or a button.

In this and some other embodiments, the ring-shaped gusset component 300 further comprises a belt 395. The belt 395 comprises a first belt body 396 and a second belt body 397. The first belt body 396 is detachably disposed on the outer lateral side of the ring-shaped gusset component 300, and the second belt body 397 is disposed on the outer lateral side of the ring-shaped gusset component 300 respectively, but the disclosure is not limited thereto. In other embodiments, they can be disposed on the inner lateral side of the ring-shaped gusset component 300. Or, in other embodiments, the first belt body 396 is directly connected to the outer lateral side of the ring-shaped gusset component 300, namely not detachable. When the first belt body 396 and the second belt body 397 are connected to each other, each of the first supporting parts 380 and each of the second supporting parts 385 are fixed to the storage position. Moreover, in this embodiment, the first belt body 396 and the second belt body 397 are disposed on the upper side and lower side of the ring-shaped gusset component 300 respectively, but the disclosure is not limited thereto. In other embodiment, the first belt body 396 and the second belt body 397 may be disposed on the left side and the right side of the ring-shaped gusset component 300 respectively.

Furthermore, in this and some other embodiments, the suitcase structure 10 further comprises a gripping part 930. The gripping part 930 is connected to the second extending part 230. The griping part 930 is configured for allowing users to grip it with one hand in order to fix the position of the second extending part 230. Thereby, users may use the other hand to drag the zipper head 420. However, in other embodiments, the gripping part 930 may be connected to the first extending part 398, and the disclosure is not limited thereto.

The storage process of the suitcase structure of this embodiment is illustrated hereinafter. Please refer to FIG. 18 and FIG. 21 to FIG. 24. FIG. 21 to FIG. 24 are schematic views of the storage process of FIG. 18.

Figure 21:
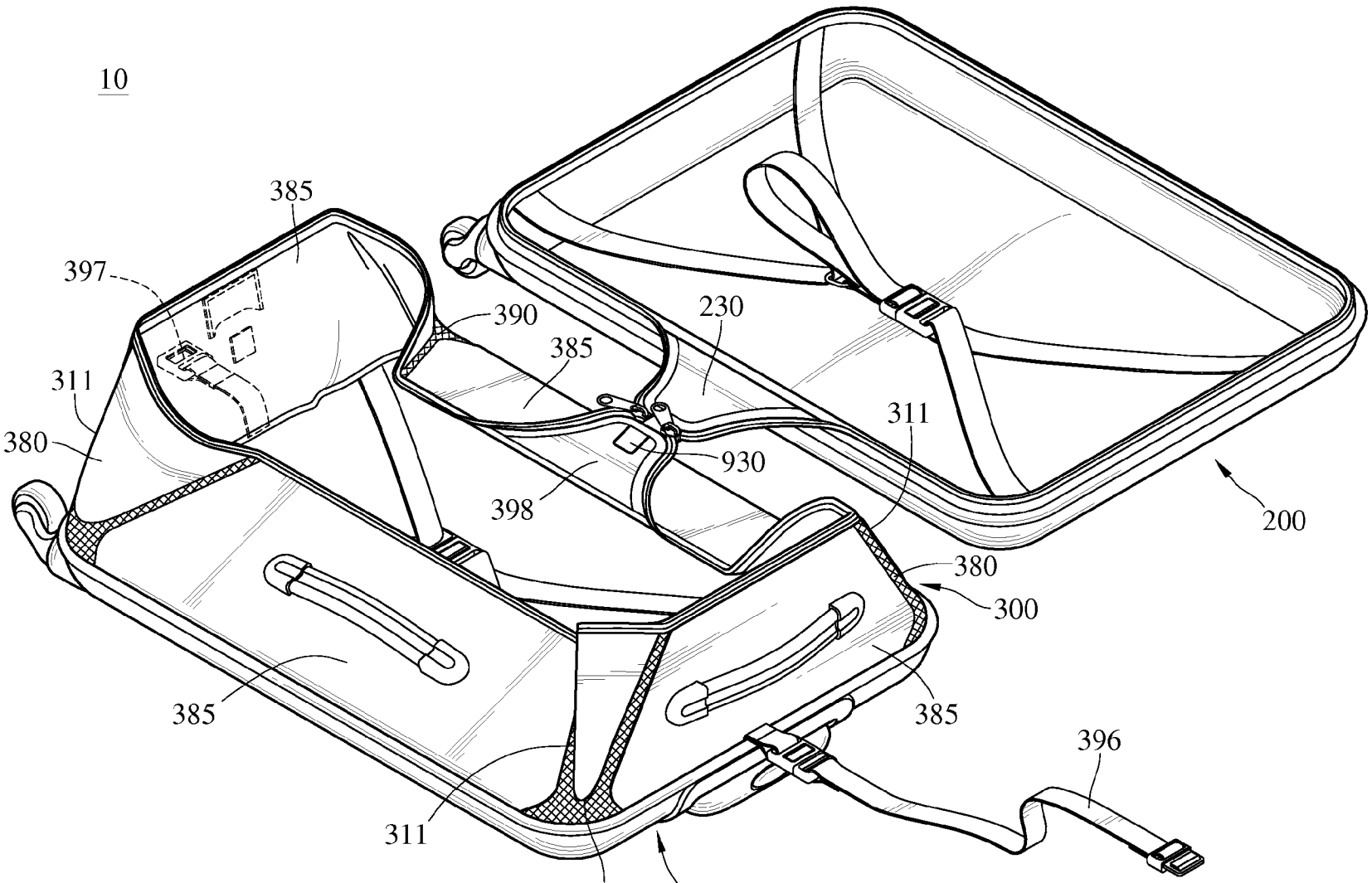
FIG. 21 to FIG. 24 are schematic views of the storage process of FIG. 18.

Firstly, according to FIG. 18, the ring-shaped gusset component 300 is erected oppositely on the back case component 100 and therefore is in a use position. At this point, goods can be stored in the accommodating space 300. Subsequently, the action of folding the ring-shaped gusset component 300 starts. As shown in FIG. 21, the two opposite second supporting parts 385 are first pressed inwardly to form the fold line 311.

Figure 22:
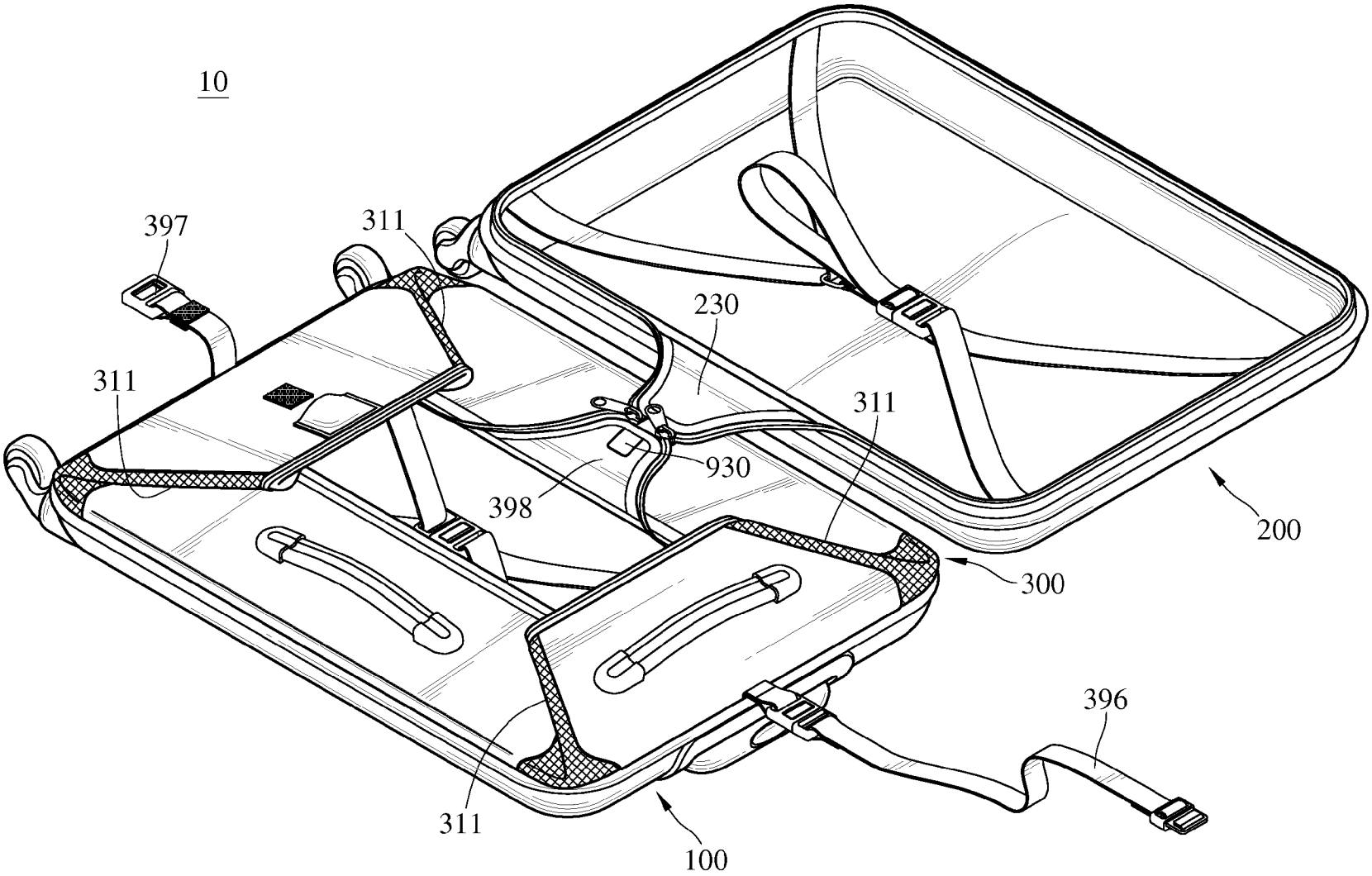
Figure 23:
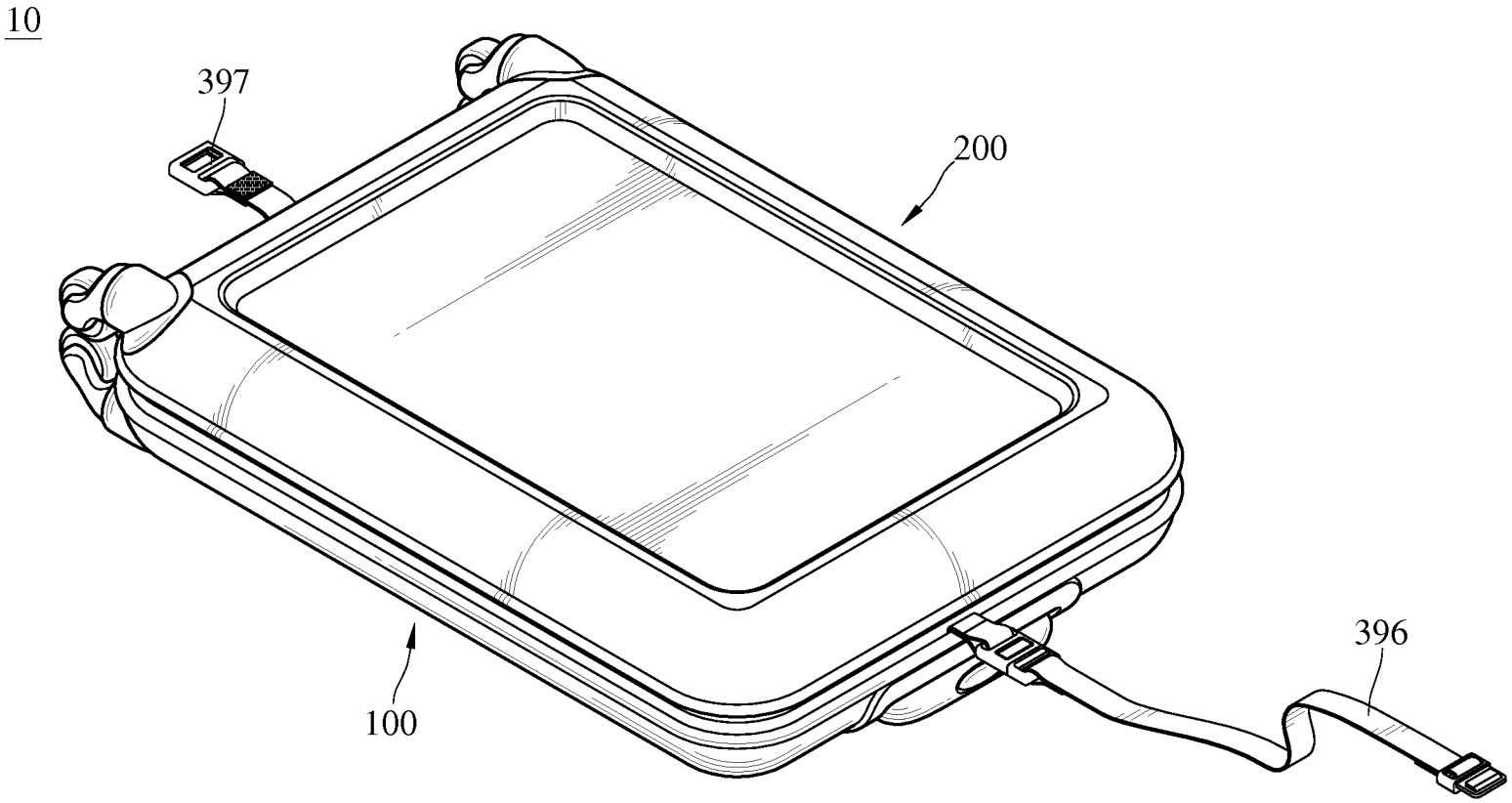
Figure 24:
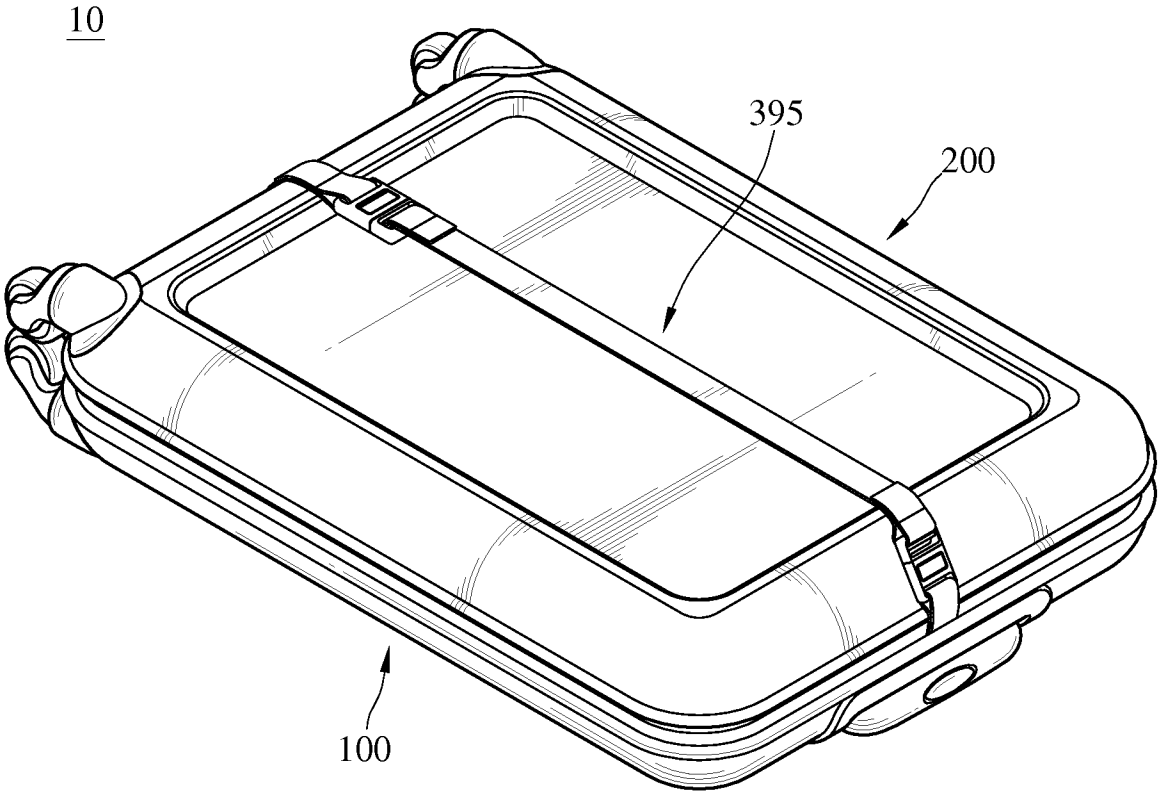

Then, as shown in FIG. 22, the rest two opposite second supporting parts 385 are folded inwardly, so as to stack each of the first supporting parts and each of the second supporting parts on the back case component 100 to be in the storage position. Subsequently, as shown in FIG. 23, the front lid component 200 is stacked on the back case component and the ring-shaped gusset component 300 which has already been stored. Additionally, each of the first supporting parts 380 and each of the second supporting parts 385 are fixed to the storage position. Lastly, as shown in FIG. 24, the first belt body 396 and the second belt body 397 are buckled up to tie the back case component 100 and the front lid component 200 together. As a result, the storage process of the suitcase structure is finished. Moreover, by comparing FIG. 24 to FIG. 17, it is found that the size of the suitcase structure 10 in the storage position is significantly smaller than that of the suitcase structure 10 in the use position.

Figure 25:
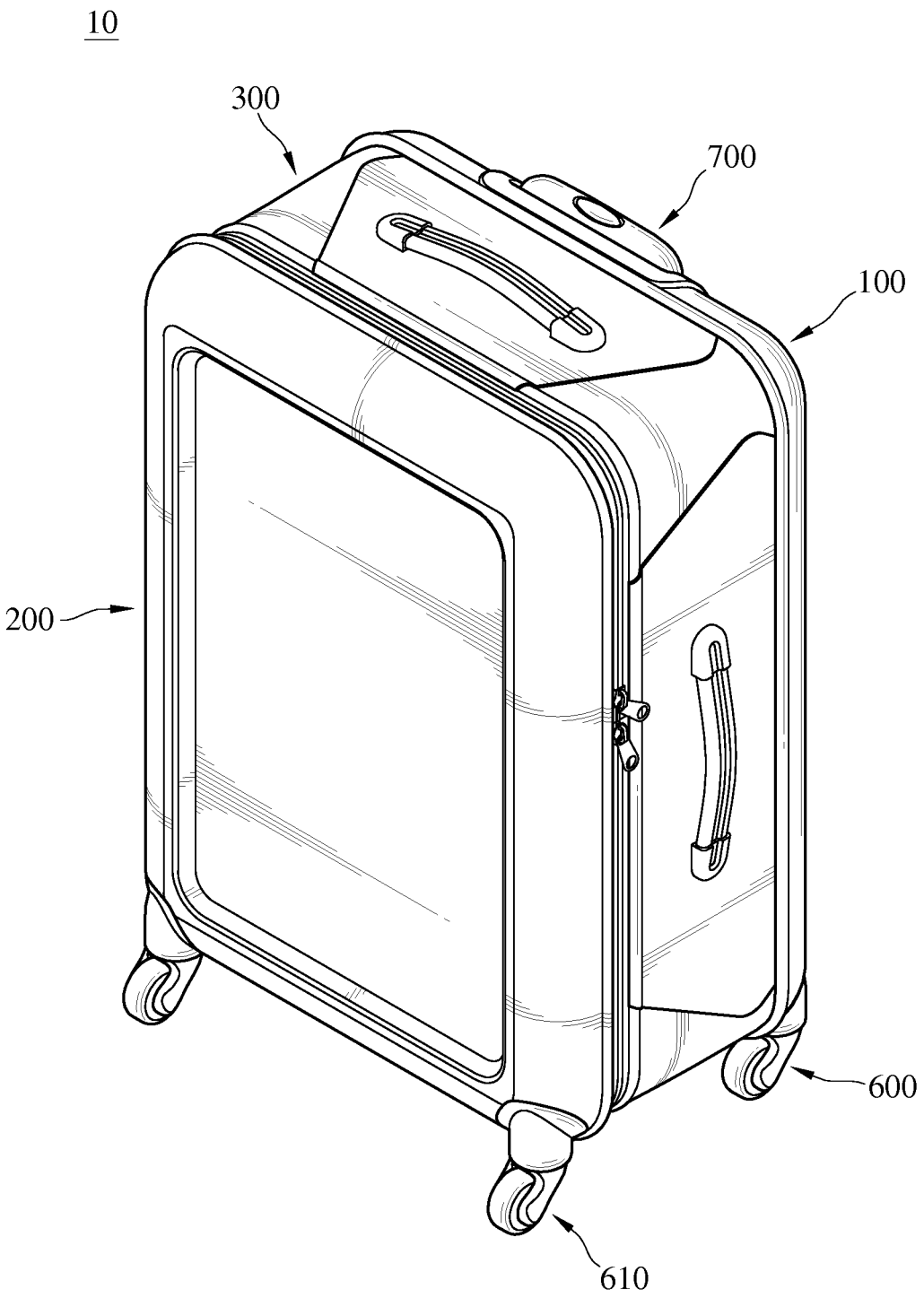
FIG. 25 is a perspective view of a suitcase structure according to a fifth embodiment of the disclosure.
Figure 26:
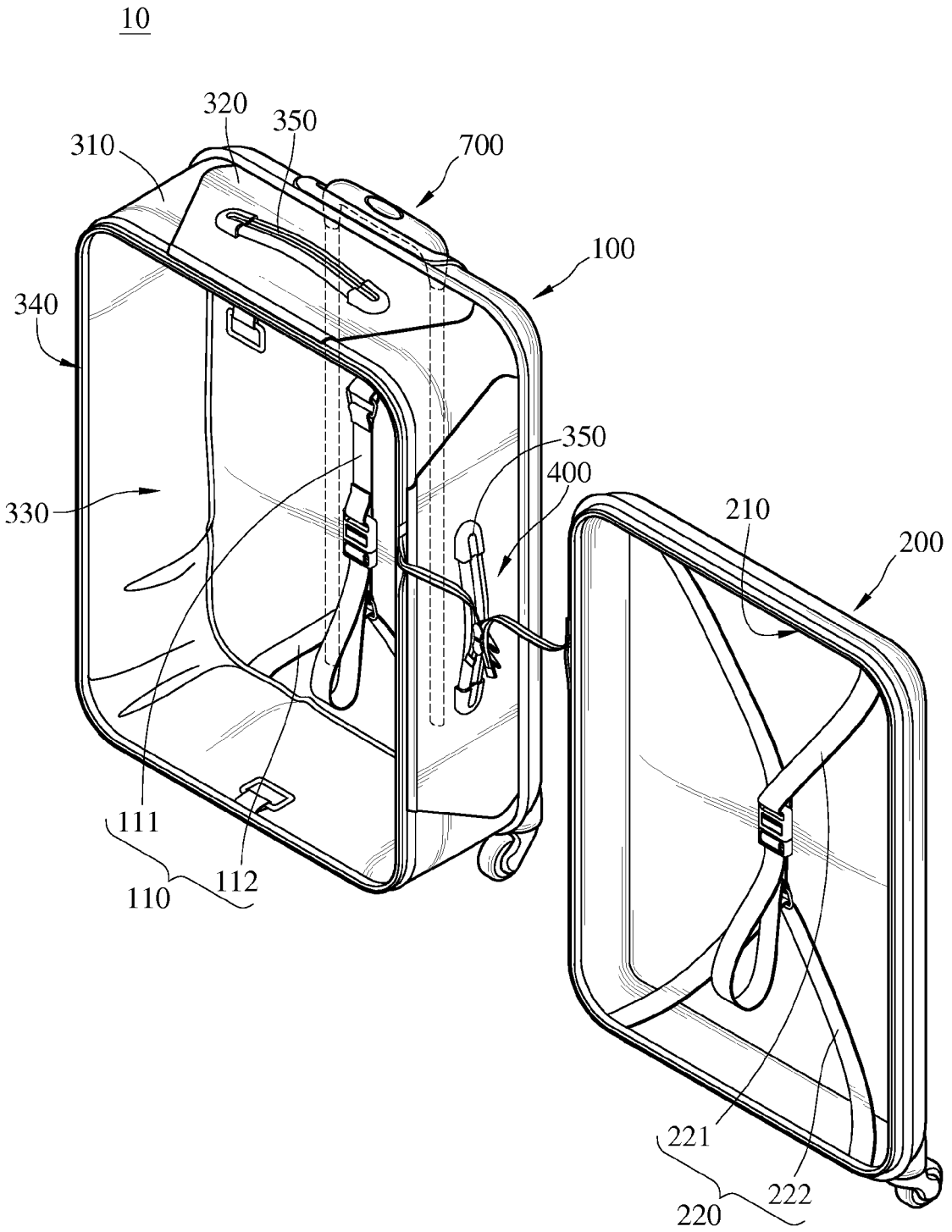
FIG. 26 is a perspective view of the opened suitcase of FIG. 25.
Figure 27A:
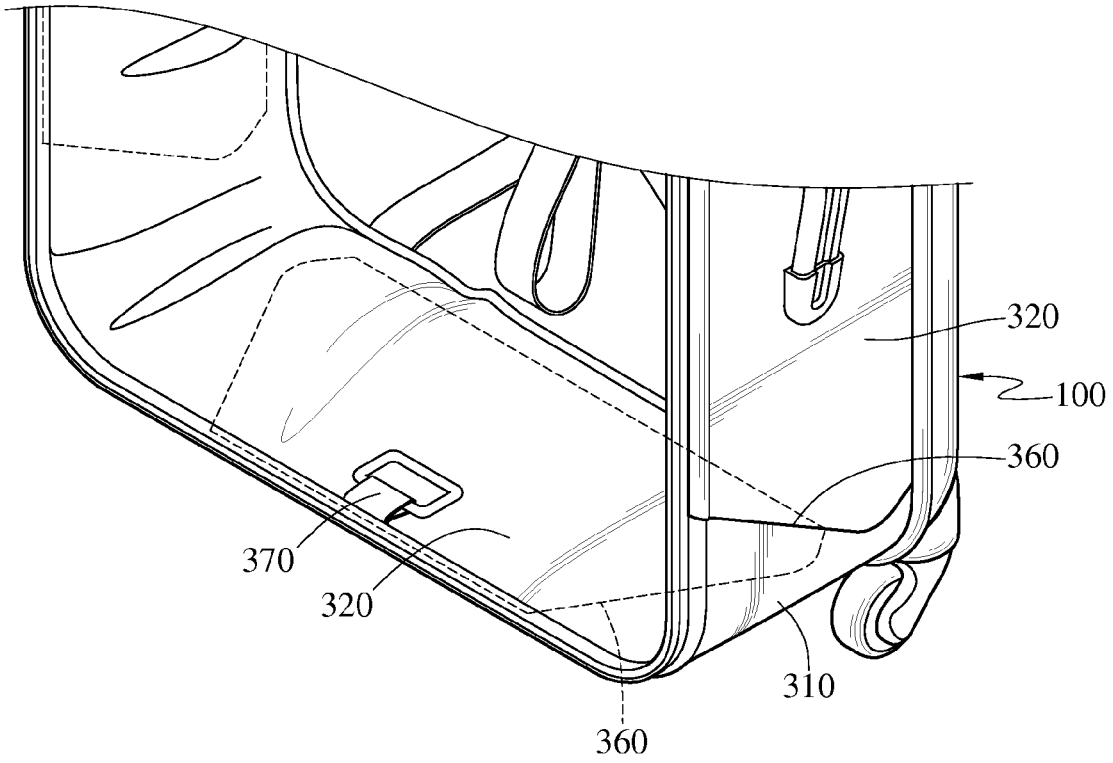
FIG. 27A is a partial enlarged view of FIG. 26.
Figure 27B:
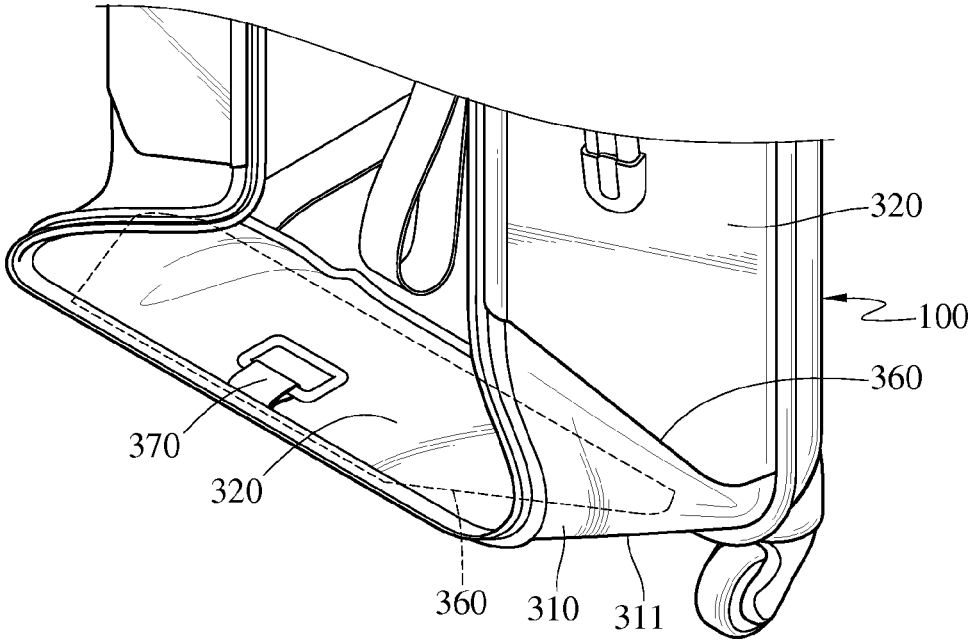
FIG. 27B is a perspective view of FIG. 27A after being bended.
Figure 28:
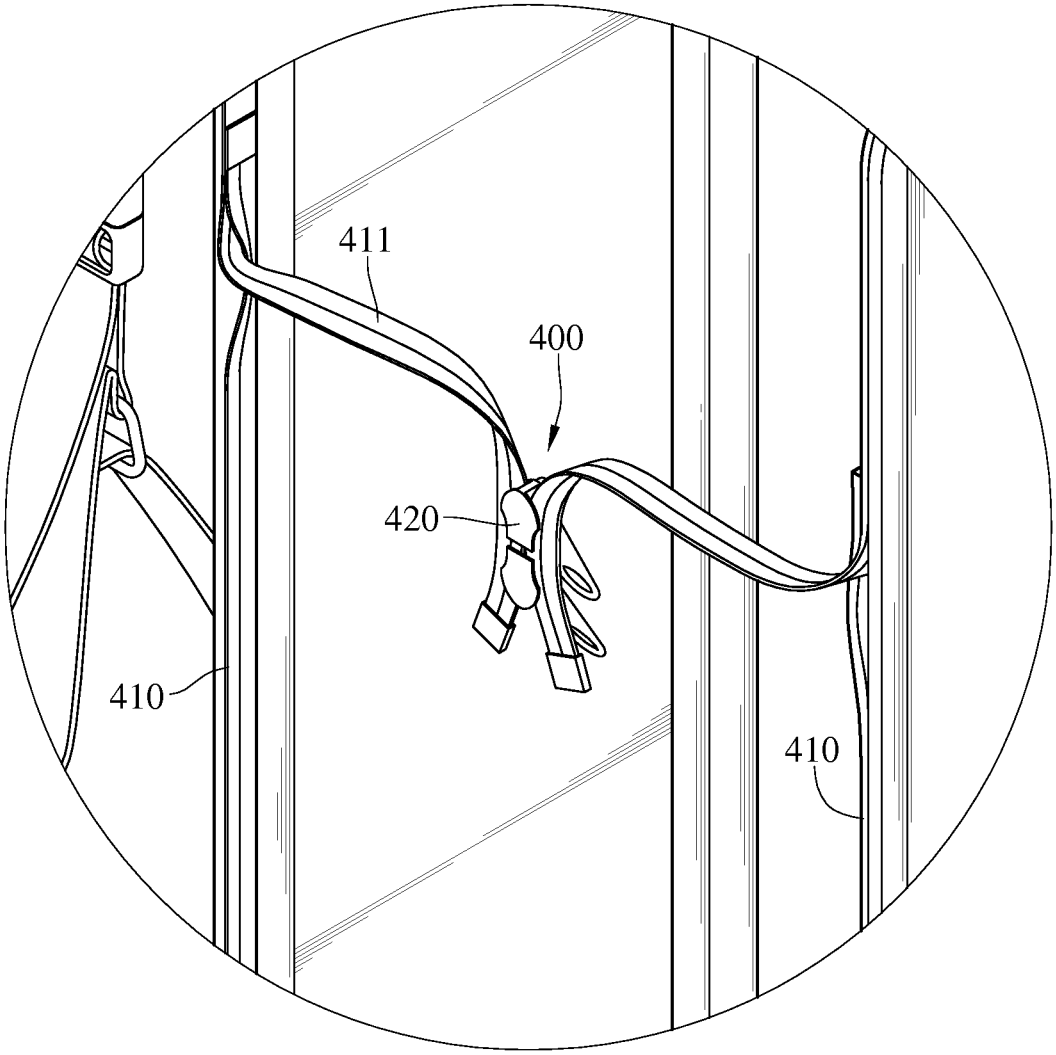
FIG. 28 is an enlarged view of the zipper part in FIG. 26.

In other embodiments, the suitcase structure 10 may have different bending structures. Please refer to FIG. 25 to FIG. 28. FIG. 25 is a perspective view of a suitcase structure according to the fifth embodiment of the disclosure. FIG. 26 is a perspective view the opened suitcase of FIG. 25. FIG. 27A is a partial enlarged view of FIG. 26. FIG. 27B is a perspective view of FIG. 27A after being bended. FIG. 28 is an enlarged view of the zipper part in FIG. 26.

In this embodiment, the suitcase structure 10 comprises a back case component 100, a front lid component 200 and a ring-shaped gusset component 300. The back case component 100 and the front lid component 200 are made by relatively harder materials due to the better protection. For example, it is made by plastic plates such as polyethylene (PE), polypropylene (PP), EVA, PVC or ABS resin, or made by fabrics.

The opposite two sides of the ring-shaped gusset component 300 are connected to the edge of the back case component 100 and the edge of the front lid component 200 respectively, to form an accommodating space 330. Specifically, in this embodiment, the ring-shaped gusset component 300 is made by composite materials, for example, the combination of plastic plates such as PE, PP, EVA or ABS and relatively softer materials such as PU, rubber, TPU, TPR. The ring-shaped gusset component 300 has a plurality of bending sections 310 and a plurality of sidewall sections 320. Each of the bending sections 310 is located at each of the end corners of the back case component 100. Each of the sidewall sections is located at each of the lateral edges of the back case component 100. Since the bending sections 310 can be made by relatively softer materials such as PU, rubber, TPU or TPR, while the inside of the sidewall section can be made by relatively harder materials, for example, the plastic plate such as PE, PP or ABS, or made by wood plate, iron frame, paper plate, aluminum plate, iron wire frame, iron plate or magnesium alloy plate. Thereby, the flexible deformation capability of each of the bending sections 310 is greater than that of each of the sidewall sections 320. The plurality of bending sections are bendable, so as to make the plurality of sidewall sections 320 be able to be stacked oppositely or erected on the back case component 100 and thereby having a storage position and a use position.

Specifically, since the flexible deformation capability of the bending section 10 is large and the bending section 10 is bendable, so users are able to bend the bending section 310 to change the form of the ring-shaped gusset component 300. Thereby, the purpose of storing the suitcase structure 10 is reached. Since the flexible deformation capability of the sidewall section 320 is less than that of the bending section 310 (namely the rigidity of the sidewall section 320 is greater than that of the bending section 310), better protection and supporting effect can be achieved by the sidewall section 320. Additionally, to make each of the sidewall sections 320 be able to be stacked or erected on the back case component 100, a crease or a material with a better flexible deformation capability may be disposed between each sidewall section and each back case component 100. Thereby, each sidewall section 320 can be folded relative to the back case component 100.

Furthermore, the bending section 310 has at least one fold line 311 (as shown in FIG. 27B). The fold line 311 can be man-made, or be produced by machines (for example, by imprinting), in order to facilitate users to store or use the suitcase structure 10.

In this and some other embodiments, there are two convergence lines 360 between each of the bending sections 310 and two adjacent sidewall sections 320. The convergence line 360 may be a curve (as shown in FIG. 27A) or an arc, but the disclosure is not limited thereto. In other embodiments, the convergence line 360 may be a straight line, and the two adjacent convergence lines 360 may be parallel to each other, or be in a relation that the distance between one end of each convergence line 360 is greater than that of the other end of each convergence line 360.

Moreover, in this embodiment, the ring-shaped gusset component 300 has a first opening 340, the front lid component has a second opening 210. The front lid component 200 is connected to the ring-shaped gusset component 300 by a zipper 400 to form the accommodating space 330. The zipper 400 comprises two chains 410 and two zipper heads 420. The two chains 410 are disposed around the edge of the first opening 340 and the edge of the second opening 210. The two zipper heads 420 are configured for tying the two chains 410 together of separating them, so as to close or open the suitcase structure 10. However, the zipper 400 is just one of the connection structures between the front lid component 200 and the ring-shaped gusset component 300. In other embodiments, the connection structure may be a Velcro or a button.

In this embodiment, one end of the two chains 410 extends and is connected to each other to form a connection section 411. The connection section 411 is located between the front lid component 200 and the ring-shaped gusset component 300. Additionally, the connection section 411 has a length to enable the front lid component 200 and the ring-shaped gusset component 300 to be separated from each other and be maintained a distance between them. In this embodiment, for example, the length of the connection section 411 (namely the distance between the front lid component 200 and the ring-shaped gusset component 300) is greater than the width of the ring-shaped gusset component 300. Thereby, a space can be vacated for users to bend the bending section 310 in order to stack each of the sidewall sections 420 on the back case component 100.

In this embodiment, the suitcase structure 10 further comprises a plurality of first wheels 600 and a plurality of second wheels 610. The plurality of first wheels 600 are disposed on the back case component 100, and the plurality of the second wheels 60 are disposed on the front lid component 200. Nevertheless, the positions and quantities of the aforementioned wheels 600 and 610 are not intended to limit the disclosure.

In this and some other embodiments, the suitcase structure further comprises at least one handle grip 350. The handle grip 350 is disposed on the ring-shaped gusset component 300. Specifically, to enable users to carry the suitcase structure 10 at different angles, two handle grips 350 can be disposed on the opposite sidewall sections 320 respectively.

In this and some other embodiments, the back case component 100 has a belt 110. The belt 110 comprises a first belt body 111 and a second belt body 112 which are able to be separated from each other and be connected with each other. When the first belt body 111 and the second belt body 112 are connected with each other, they are configured for surrounding the back case component 100 and the stored ring-shaped gusset component 300, to make the back case component 100 and the ring-shaped gusset component 300 close to the front lid component 200. Nonetheless, the belt 110 can not only be used to tighten the back case component 100 and the ring-shaped gusset component 300, but also be used to constrain the goods stored inside the back case component 100 and the ring-shaped gusset component 300. Consequently, the front lid component 200 further comprises a belt 220. The belt 220 comprises a first belt body 221 and a second belt body 222. The first belt body 221 and the second belt body 222 are located on opposite two sides of the front lid component 200 respectively. The first belt body 221 and the second belt body 222 are connected to constrain the goods inside the front lid component 200.

In this and some other embodiments, the ring-shaped gusset component 300 further comprises two retaining rings 370. The two retaining rings 370 are located on two opposite sides of the first opening respectively. The first belt body 111 and the second belt body 112 of the belt 110 of the back case component 100 are configured for passing through the two retaining rings 370 and being connected to each other.

Figure 29:
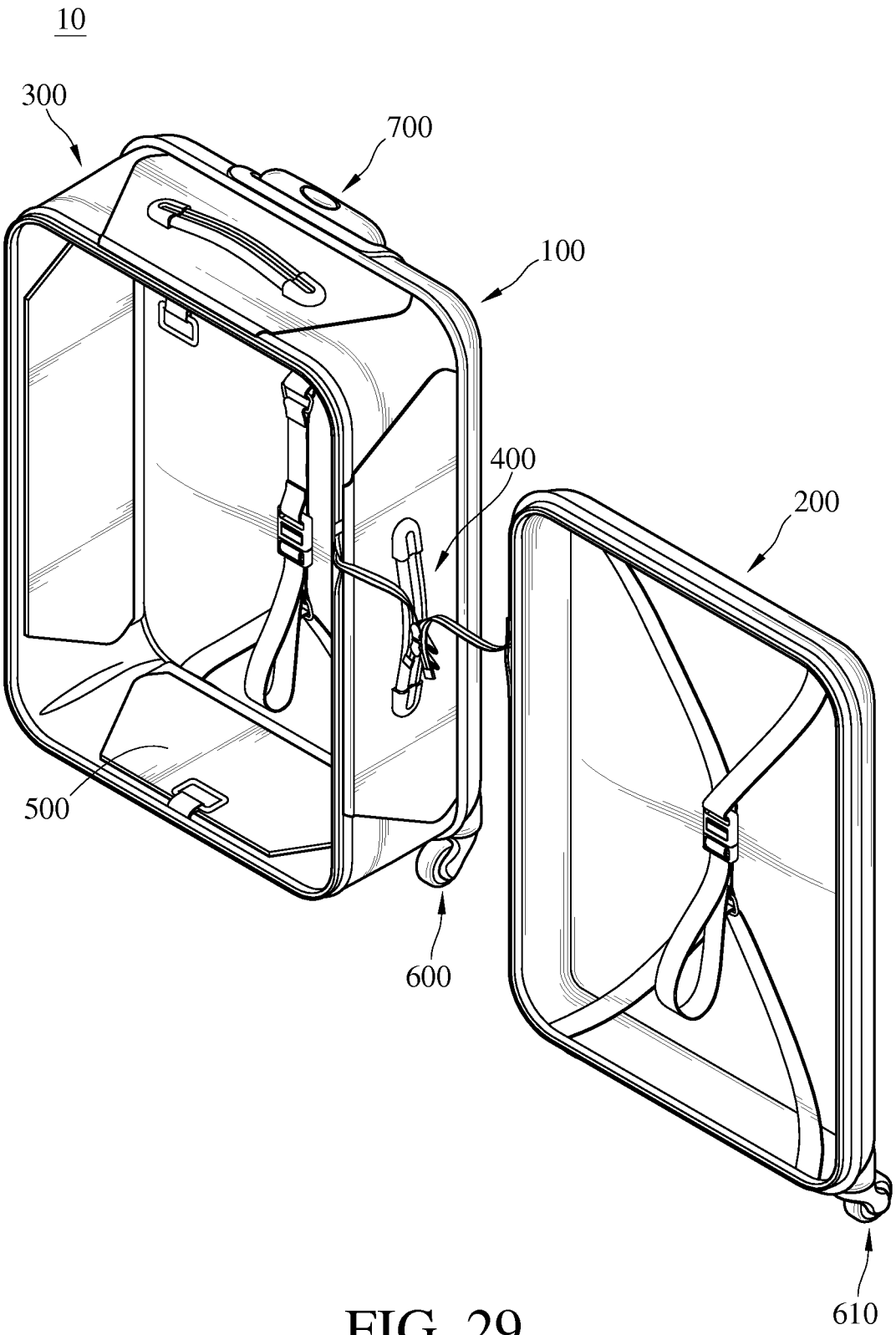
FIG. 29 is a perspective view of an opened suitcase structure according to a sixth embodiment of the disclosure.

Please refer to FIG. 29. FIG. 29 is a perspective view of an opened suitcase structure according to a sixth embodiment of the disclosure. In this embodiment, the suitcase structure 10 further comprises at least one honeycomb board 500. The honeycomb board 500 is fixed to the ring-shaped gusset component 300, and is configured for supporting the ring-shaped gusset component 300. Thereby, the structural strength of the suitcase structure 10 can be enhanced. However, in other embodiments, the honeycomb board 500 may be replaced by other components having stronger structural strength than the ring-shaped gusset component 300, such as an iron wire frame, a wood plate, a plastic plate, an iron plate, an aluminum plate, rubber, or a magnesium alloy plate.

The storage process of the suitcase structure of this embodiment is illustrated hereinafter. Please refer to FIG. 26 and FIG. 30 to FIG. 33. FIG. 30 to FIG. 33 are schematic views of the storage process of FIG. 10.

Figure 30:
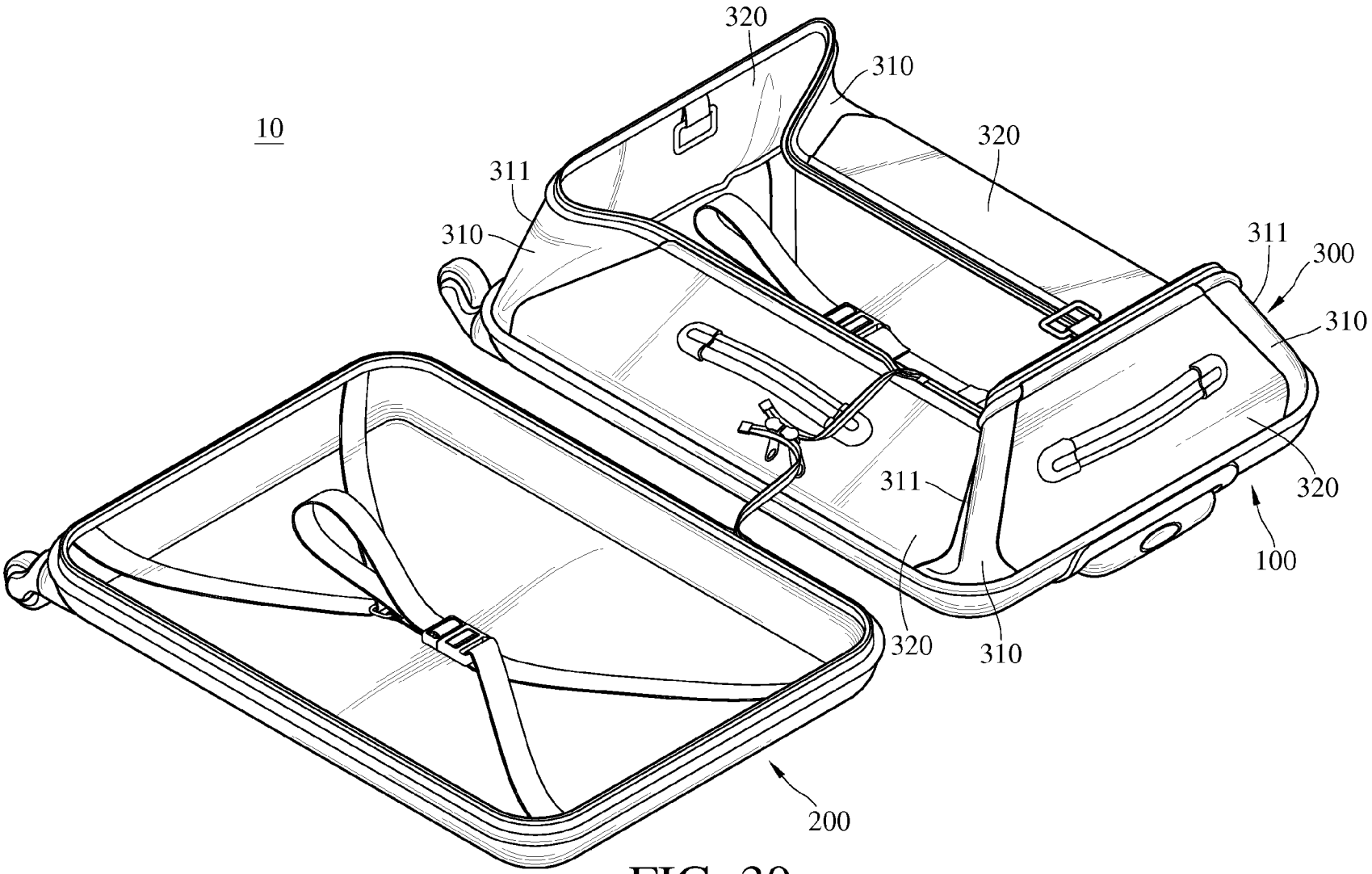
FIG. 30 to FIG. 33 are schematic views of the storage process of FIG. 26.

At first, as shown in FIG. 26, the ring-shaped gusset component 300 is erected oppositely on the back case component 100 and therefore is in the use position. At this point, goods can be stored in the accommodating space 330. Then, the process of folding the ring-shaped gusset component 300 begins. As shown in FIG. 30, the two opposite sidewall sections 320 are first pressed inwardly to form the fold line 311. Since four bending sections 310 connected to the two sidewall sections 320 are bendable, the two sidewall sections 320 can be stacked on the back case component 100.

Figure 31:
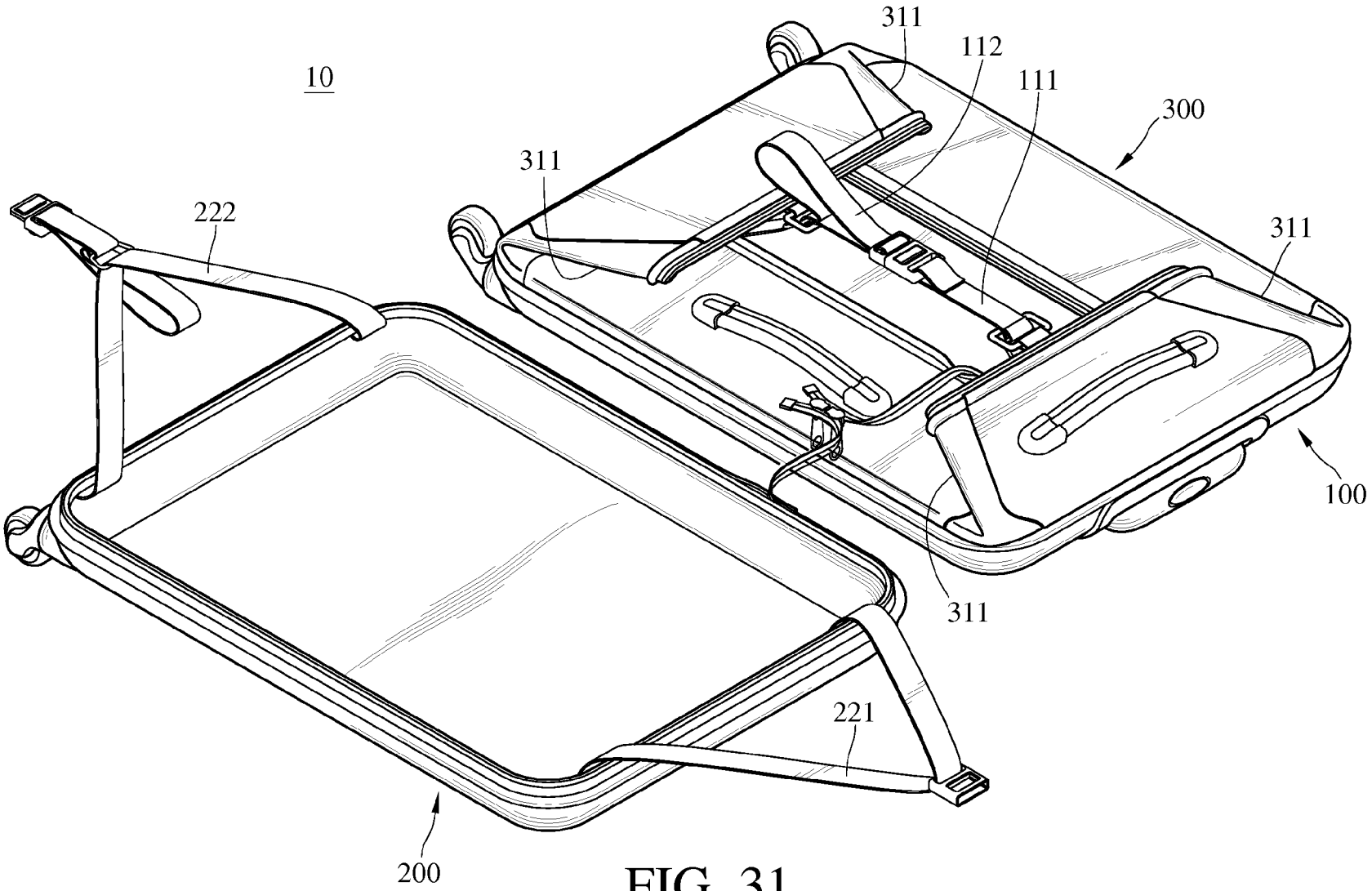
Figure 32:
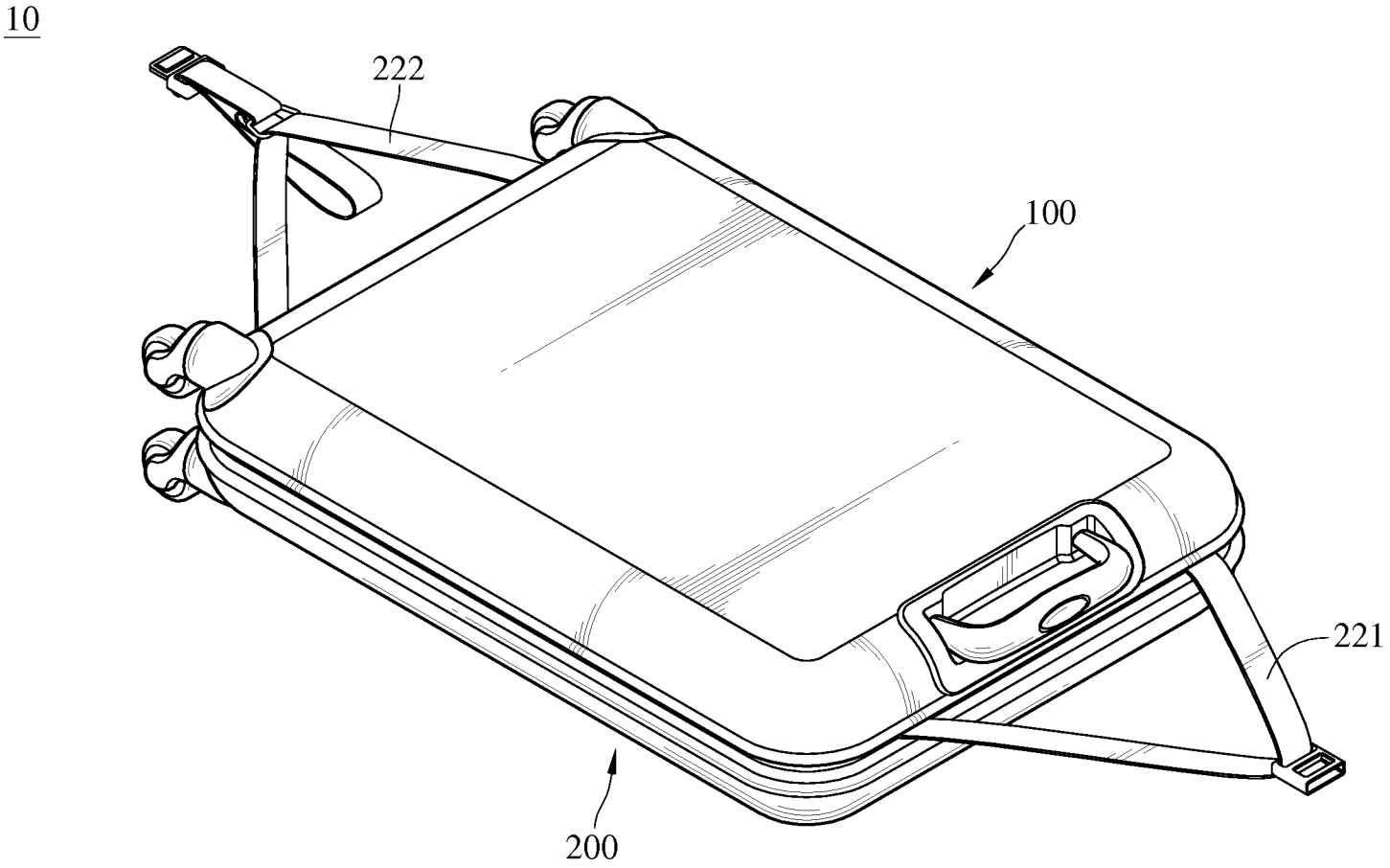
Figure 33:
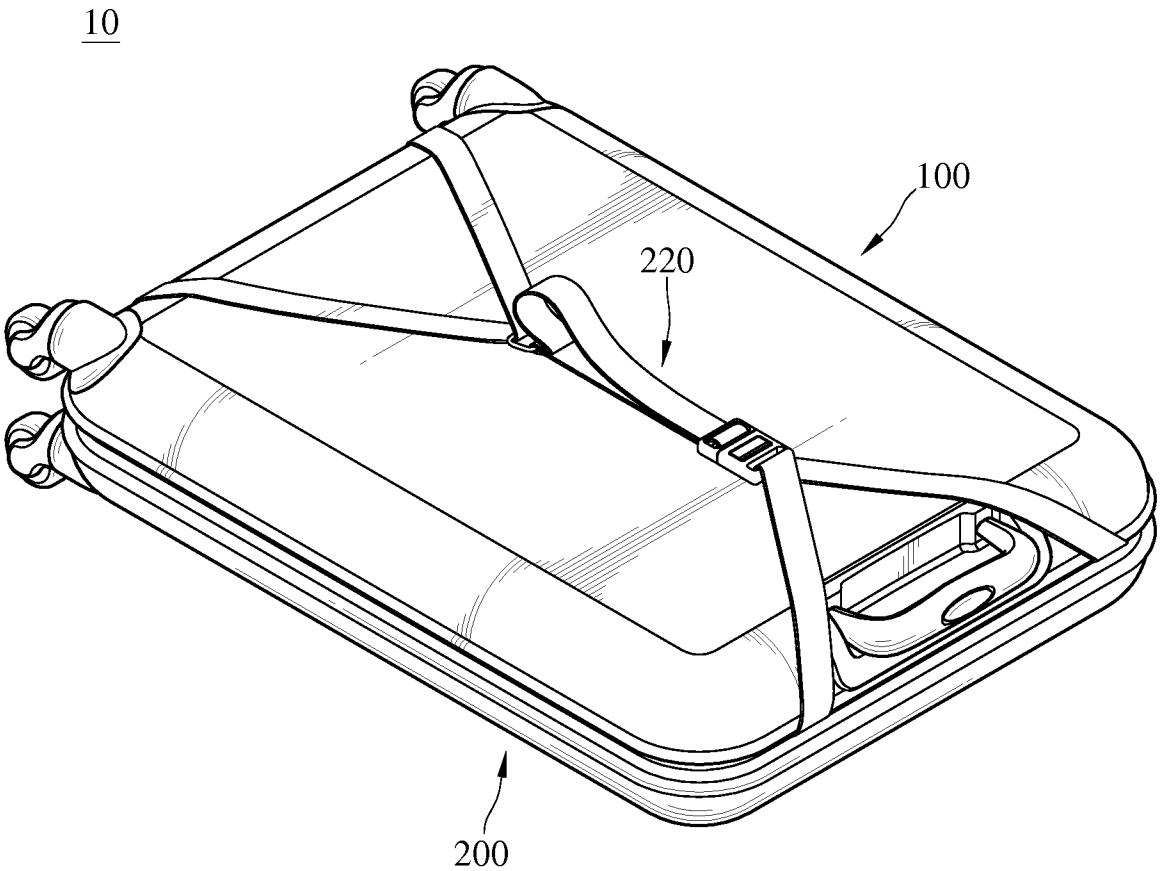

Then, as shown in FIG. 31, the rest two opposite sidewall sections 320 are folded inwardly, so as to stack each of the sidewall sections 320 on the back case component 100 in order to be in the storage position. Additionally, the first belt body 111 and the second belt body 122 of the belt 110 can be disposed through and connected, as shown in FIG. 32, in which the back case component 100 and the ring-shaped gusset component 300 which has already been stored are stacked on the front lid component 200. Lastly, as shown in FIG. 33, the first belt body 221 and the second belt body 222 of the belt 220 are connected with each other, so as to finish the storage process of the suitcase structure 10. Furthermore, by comparing FIG. 33 to FIG. 25, it is found that the size of the suitcase structure 10 at the storage position is significantly less than that of the suitcase structure 10 at the use position.

Figure 34:
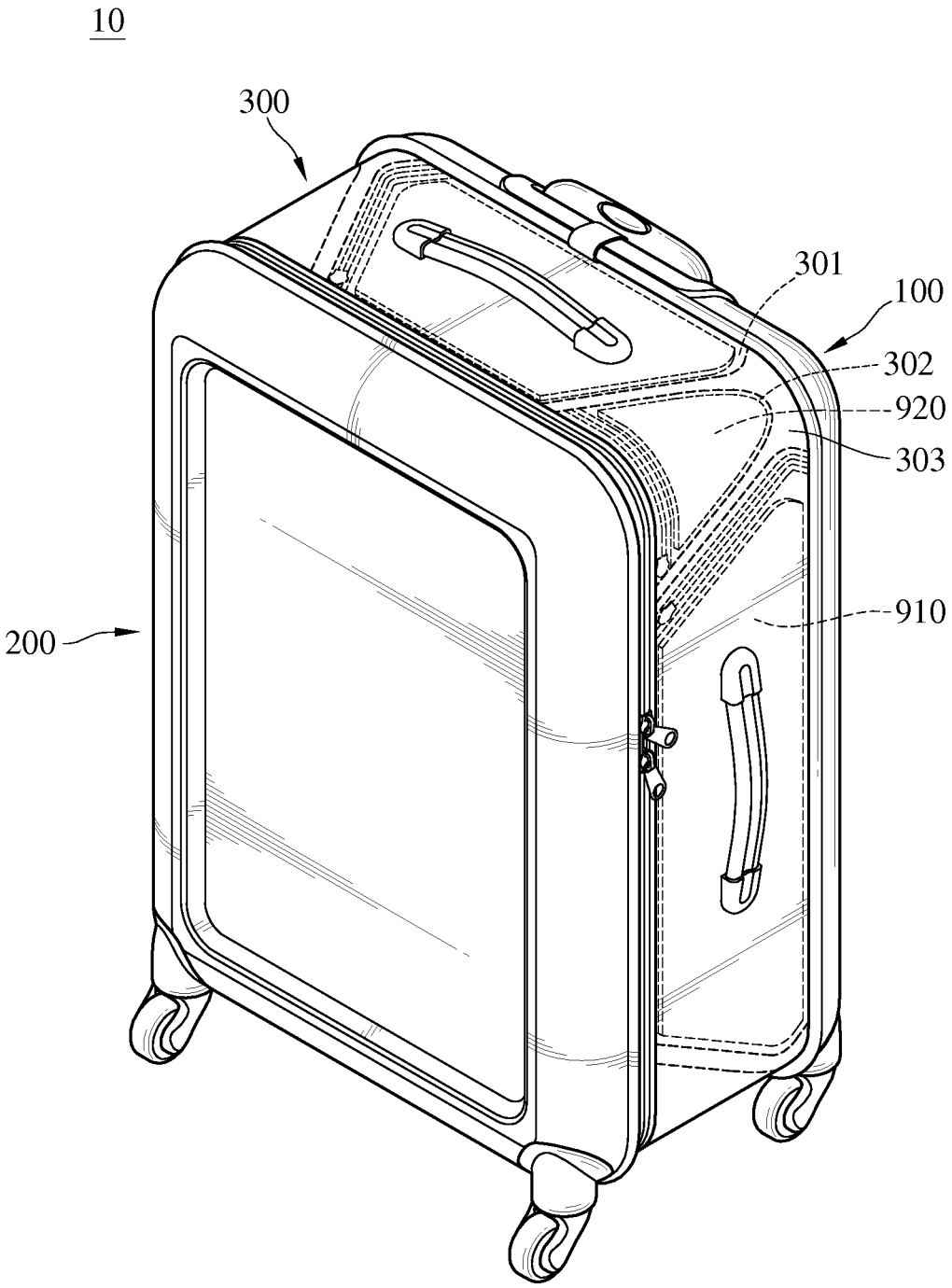
FIG. 34 is a perspective view of a suitcase structure according to a seventh embodiment of the disclosure.

Please refer to FIG. 34. FIG. 34 is a perspective view of a suitcase structure according to a seventh embodiment of the disclosure.

In this embodiment, a suitcase structure 10 comprises a back case component 100, a front lid component 200 and a ring-shaped gusset component 300. The back case component 100 and the front lid component 200 are made by relatively harder materials due to the better protection. For example, they are made by plastic plates such as polyethylene (PE), polypropylene (PP), EVA or ABS resin, or made by fabrics.

The two opposite sides of the ring-shaped gusset component 300 are connected to the edge of the back case component 100 and the edge of the front lid component 200, so as to form an accommodating space 330. The ring-shaped gusset component 300 has a plurality of first accommodating parts 301, a plurality of second accommodating parts 302, a plurality of first reinforcement elements 910 and a plurality of second reinforcement elements 920. The plurality of first accommodating parts 301 are each located at each side edge of the back case component 100. The plurality of second accommodating parts 302 are each located at each end corner of the back case component 100. Each of the first accommodating parts 301 and each of the second accommodating parts 302 kept apart by a distance. The plurality of first reinforcement elements 910 are detachably disposed on the plurality of first accommodating parts 301 respectively. The plurality of second reinforcement elements 920 are each detachably disposed on the second accommodating part 302, so as to form a plurality of bending parts 303 between the first accommodating part and the second accommodating part. In this embodiment, the first reinforcement elements 910 and the second reinforcement elements 920 are plates whose hardness is greater than that of the first accommodating part 301 and the second accommodating part 302, but the disclosure is not limited thereto. In other embodiments, the first reinforcement elements 910 and the second reinforcement elements 920 may be iron wire frames, wood plates, plastic plates, iron plates, aluminum plates, paper plates, rubber or magnesium alloy plates. In this embodiment, the ring-shaped gusset component 300 has the first accommodating part 301 and the second accommodating part 302, but the disclosure is not limited thereto. In other embodiments, the ring-shaped gusset component 300 may just have the first accommodating part 301. The plurality of first reinforcement elements 910 are disposed on the first accommodating part 301 respectively, so as to form a plurality of bending parts 303 between each of the first accommodating parts 301.

Since each of the accommodating parts 301 and 302 dispose reinforcement elements 910 and 920 respectively. As a result, the hardness thereof is enhanced so that the protection effect regarding goods inside the suitcase structure 10 is improved. Since each of the bending parts 303 is not equipped with each of the reinforcement elements 910 and 920, the flexible deformation capability of each of the bending parts 303 is greater than that of each of the first accommodating parts 301 and each of the second accommodating parts 302. The plurality of bending parts 303 are bendable, so as to enable the plurality of second accommodating parts 302 to be stacked oppositely or erected on the back case component 100.

In the aforementioned suitcase structure, since the ring-shaped gusset component consists of the plurality of bending parts with different flexible deformation capabilities and the plurality of supporting parts. Additionally, each of the bending parts is bendable. Thereby, users may fold each of the supporting parts inwardly and stack thereof on the back case component. By doing this, the size of the suitcase structure after being folded is much smaller than the size of the suitcase structure before being folded, therefore facilitating the storage of the suitcase structure.

Moreover, since the ring-shaped gusset component consists of the plurality of bending sections with two different flexible deformation capabilities and the plurality of sidewall sections. Each of the bending sections is bendable, so that users may fold each of the sidewall sections inwardly and stack them on the back case component. Thereby, the size of the suitcase structure after being folded is much smaller than the size of the suitcase structure before being folded, therefore facilitating the storage of the suitcase structure.

Furthermore, since the structural strength of the honeycomb plate is stronger than that of the ring-shaped gusset component, the overall structural strength of the suitcase structure can be improved.

Additionally, a connection section is extended from the zipper of the suitcase structure, so the front lid component and the ring-shaped gusset component can be kept apart by a distance, so as to ensure that the front lid component does not disturb that users fold the ring-shaped gusset component.

What is claimed is:

1. A suitcase structure, comprising:

a back case component;

a front lid component; and a ring-shaped gusset component, wherein the opposite sides of the ring-shaped gusset component are connected with the edge of the back case component and the edge of the front lid component respectively, so as to form an accommodation space configured for being closed, the ring-shaped gusset component comprises a plurality of sidewall portions and a plurality of flexible structures linking the sidewall portions, each of the flexible structures extends from the edge of the ring-shaped gusset component connected to the back case component towards the edge of the ring-shaped gusset component connected to the front lid component, the flexible deformation capability of the flexible structures is greater than the flexible deformation capability of the sidewall portions, each of the flexible structures has an inclination, the inclination is formed and maintained between each of the flexible structures and the edge of the ring-shaped gusset component connected to the back case component, the width of each of the flexible structures decreases gradually from the place near the back case component along a direction away from the back case component, and two of the sidewall portions adjacent to each other can be bent and therefore be stacked opposite to each other by the flexible structures linking the two of the sidewall portions.

2. The suitcase structure according to claim 1, wherein the ring-shaped gusset component further comprises a fixing strap, the fixing strap comprises a first strap body and a second strap body, the first strap body and the second strap body are disposed on the sidewall portions opposite to each other, and the first strap body is detachably connected to the second strap body.

3. The suitcase structure according to claim 1, wherein the front lid component has a belt, the belt is configured for being sleeved on the back case component and the ring-shaped gusset component, so as to make the back case component and the ring-shaped gusset component close to the front lid component.

4. The suitcase structure according to claim 1, wherein the front lid component forms the accommodation space by a connection structure installed on the ring-shaped gusset component.

5. The suitcase structure according to claim 4, wherein the connection structure is a zipper.

6. The suitcase structure according to claim 5, wherein the ring-shaped gusset component has a first opening while the front lid component has a second opening, the zipper comprises two chains and a zipper head, the two chains are disposed on the edge of the first opening and the edge of the second opening respectively, the ends of the two chains extend and are combined in order to form a connection section, and the zipper head is configured for closing the two chains or for separating the two chains apart.

7. The suitcase structure according to claim 5, wherein the ring-shaped gusset component has a first opening and comprises a first extending part, the first extending part is connected to the edge of the ring-shaped gusset component forming the first opening, the front lid component has a second opening and comprises a second extending part, the second extending part is connected to the edge of the front lid component forming the second opening, the zipper comprises two chains and two zipper heads, one of the two chains is sleeved on the edge of the first opening and the edge of the first extending part, the other chain is sleeved on the edge of the second opening and the edge of the second extending part.

8. The suitcase structure according to claim 7, further comprising a grip part connected to the second extending part.

9. The suitcase structure according to claim 5, wherein the ring-shaped gusset component has a first opening while the front lid component has a second opening, one of the sidewall portions has a lateral part and a linking part, the lateral part has a concave located on an outer wall surface of the lateral part, one lateral edge of the linking part is connected to the edge of the lateral part forming the concave, the other lateral edge of the linking part is connected to the edge of the front lid component forming the second opening, the zipper comprises two chains and a zipper head, one of the two chains is disposed on the edge of the first opening and the edge of the concave, the other chain is disposed on the edge of the second opening and the edge of the linking part, the zipper head is configured for closing the two chains for making the linking part cover the outer wall surface of the lateral part and is also configured for separating the two chains apart.

10. The suitcase structure according to claim 9, wherein the linking part is detachably connected to the lateral part.

11. The suitcase structure according to claim 9, wherein the zipper comprises a zipper piece movably disposed on the zipper head and the zipper piece is out of the accommodation space.

12. The suitcase structure according to claim 5, wherein the ring-shaped gusset component has a first opening while the front lid component has a second opening, one of the sidewall portions has a lateral part and a linking part, the lateral part has a concave located on the edge of the first opening, a lateral edge of the linking part is connected to the edge of the lateral part forming the concave, and a part of the linking part is separated from the lateral part, another lateral edge of the linking part is connected to the edge of the front lid component forming the second opening, the zipper comprises two chains and a zipper head, one of the two chains is disposed on the edge of the first opening and the edge of the concave, the other chain is disposed on the edge of the second opening and the edge of the linking part, the zipper head is configured for closing the two chains for making the linking part and the lateral part together from one of the sidewall portions and is also configured for separating the two chains apart.

13. The suitcase structure according to claim 1, further comprising at least one reinforcing element disposed on at least one of the sidewall portions.

14. The suitcase structure according to claim 1, further comprising a handle and a reinforcing element, the handle and the reinforcing element are disposed on the same one of the sidewall portions, the handle is located on an outer wall surface of the same one of the sidewall portions, and the projection areas of the reinforcing element and the handle on the sidewall portions overlap.

* * * * *